US006930647B2

(12) United States Patent
Wako et al.

(10) Patent No.: US 6,930,647 B2
(45) Date of Patent: Aug. 16, 2005

(54) SEMICIRCULAR RADIAL ANTENNA

(75) Inventors: Iichi Wako, Tokyo (JP); Hisamatsu Nakano, Tokyo (JP); Yusuke Yamamoto, Kanagawa (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 0 days.

(21) Appl. No.: 10/147,302

(22) Filed: May 17, 2002

(65) Prior Publication Data

US 2002/0186173 A1 Dec. 12, 2002

(30) Foreign Application Priority Data

May 17, 2001 (JP) ..... P2001-152764
May 22, 2001 (JP) ..... P2001-148025
Jun. 15, 2001 (JP) ..... P2001-181901
Aug. 7, 2001 (JP) ..... P2001-239278

(51) Int. Cl.[7] ..... H01Q 13/00; H01Q 13/02
(52) U.S. Cl. ..... 343/772; 343/786
(58) Field of Search ..... 343/772, 786, 343/776, 784, 783, 785; H01Q 13/00, 13/02

(56) References Cited

U.S. PATENT DOCUMENTS 2,459,768 A 1/1949 Cork et al.
3,116,485 A 12/1963 Carson
3,434,146 A 3/1969 Petrich
3,530,481 A 9/1970 Tanaka et al.
3,775,773 A 11/1973 Nemit
4,814,777 A 3/1989 Monser
5,714,964 A 2/1998 Jackson
5,861,844 A 1/1999 Gilmore et al.
5,973,653 A * 10/1999 Kragalott et al. ..... 343/786
6,144,339 A 11/2000 Matsumoto et al.
6,275,196 B1 * 8/2001 Bobier ..... 343/840
6,292,053 B1 * 9/2001 Ke ..... 330/51
6,549,164 B2 * 4/2003 Paschen et al. ..... 342/371

FOREIGN PATENT DOCUMENTS

EP 1 076 379 A2 2/2001
JP 54-173650 U 5/1978
JP 58-20161 B 4/1983
JP 59-8408 A 1/1984
JP 61-219203 A 9/1986
JP 62-81584 A 4/1987
JP 62-151003 A 6/1987
JP 62-199102 A 9/1987
JP 3-29503 A 2/1991
JP 5-235634 A 9/1993
JP 6-9218 U 2/1994
JP 2553585 8/1996
JP 9-222506 A 8/1997
JP 11-122022 A 4/1999
JP 2000-332532 A 11/2000
JP 2001-127532 A 5/2001
WO WO 00/01033 1/2000

* cited by examiner

*Primary Examiner*—Hoanganh Le
(74) *Attorney, Agent, or Firm*—Sughrue Mion, PLLC

(57) ABSTRACT

At least one of the following requirements is satisfied. A position of a curvature center of an arcuate portion in at least one of waveguide plates is selected between a connecting member and a feeder, in accordance with a desired horizontal beam radiation characteristic. A curvature radius of the arcuate portion in at least one of the waveguide plates is selected in accordance with a desired vertical beam radiation characteristic. A slanted angle of a peripheral face of the arcuate portion, which connects a top face and a bottom face of each waveguide plate, in at least one of the waveguide plates is selected in accordance with a desired vertical beam radiation characteristic.

25 Claims, 20 Drawing Sheets

SEMICIRCULAR RADIAL ANTENNA

BACKGROUND OF THE INVENTION

The invention relates to a semicircular radial antenna having a wide-angle beam used within the range of GHz to tens of GHz.

A horn antenna has generally been known as an antenna for radiating, in the form of a beam, a radio wave within the range of GHz to tens of GHz. Since the horn antenna has a narrow angle of horizontal radiation, consideration has recently been given to a semicircular radial antenna having a wide-angle beam radiation characteristic.

The semicircular radial antenna comprises a semicircular upper waveguide plate and a semicircular lower waveguide plate. The waveguide plates are spaced a predetermined distance from each other so as to oppose each other. Base portions (i.e., linear edges) of the waveguide plates are short-circuited by a short-circuit wall, thereby constituting a semicircular radial waveguide between the upper and lower waveguide plates. Power is externally fed to the semicircular radial waveguide. Such an antenna can achieve a wide-angle beam characteristic such that half width is about 120°.

As mentioned above, the semicircular radial antenna achieves a wide-angle beam characteristic. However, there has not been considered the relationship among the structure of semicircular antenna, the horizontal beam width and the orientation of a radiated vertical beam. In addition, improvements in gains thereof are further expected.

In recent years, a radio wave in a GHz band is used in many cases in a communication system such as a satellite broadcast, a GPS, a mobile terminal, an ETC (Electronic Toll Collection) system, etc. For example, a 2.5 GHz band is used in the satellite broadcast and a 2 GHz band is used in the mobile terminal. Further, a 1.5 GHz band is used in the GPS and a 5 GHz band is used in the ETC. Further, the arriving direction of the radio wave in the satellite broadcast and the GPS is the zenithal direction. The arriving direction of the radio wave in the mobile terminal is the horizontal direction. Accordingly, these arriving directions are different from each other. Therefore, the radio wave as an object is conventionally received by using a dedicated antenna with respect to each communication system.

In this situation, it is necessary to arrange plural kinds of antennas when plural communication systems are utilized. It is complicated to arrange the plural kinds of antennas in this way, and the required area to arrange the antennas is increased. Accordingly, it is desired to receive the radio wave by a single kind of antenna in the plural communication systems. However, when the radio wave of each communication system is received by a single kind of antenna, since the arriving directions of the radio wave are different from each other as described the above, it was difficult to practically use the antenna since multidirectivity was required.

SUMMARY OF THE INVENTION

It is therefore a first object of the invention to provide a semicircular antenna which is capable of variably setting the width of a horizontal beam and change the orientation of a vertical beam radiation.

A second object of the invention is to provide a semicircular radial antenna capable of improving a gain thereof.

A third object of the present invention is to provide a multidirectional antenna in which plural radio waves having different arriving directions can be received by a semicircular radial antenna.

In order to achieve the above objects, according to the present invention, there is provided a semicircular radial antenna, comprising:

- a pair of semicircular waveguide plates, having a pair of linear edge portions, an arcuate edge portion defined between the linear edge portions, the waveguide plates spaced from each other in a vertical direction;
- a connecting member, which physically and electrically connects at least a part of the linear edge portions in each waveguide plate; and
- a feeder provided between the waveguide plates while being spaced from the connecting member, wherein at least one of the following requirements is satisfied:

- i) a position of a curvature center of the arcuate portion in at least one of the waveguide plates is selected between the connecting member and the feeder in accordance with a desired horizontal beam radiation characteristic;
- ii) a curvature radius of the arcuate portion in at least one of the waveguide plates is selected in accordance with a desired vertical beam radiation characteristic; and
- iii) a slanted angle of a peripheral face of the arcuate portion, which connects a top face and a bottom face of each waveguide plate, in at least one of the waveguide plates is selected in accordance with a desired vertical beam radiation characteristic.

Here, the term "semicircular" does not mean "complete half-circle", but "incomplete circle". Furthermore, the "linear edge" may be curved if the required beam radiation characteristic is obtained.

Preferably, at least one of the waveguide plates is slidably fixed on the connecting member such that the position of the curvature center is adjustable.

Alternatively, it is preferable that at least one of the waveguide plates is detachably fixed on the connecting member.

According to the above configurations, the width of a horizontal beam and/or the orientation of a vertical radiation beam can be arbitrarily adjusted.

Preferably, the semicircular radial antenna further comprises:

- a first plate member disposed on a top face of an upper waveguide plate so as to form a groove between the top face and the plate member and along the arcuate portion; and
- a second plate member disposed on a bottom face of a lower waveguide plate so as to form a groove extending along the arcuate portion between the bottom face and the plate member.

Preferably, the peripheral face of the arcuate portion is formed with at least one groove extending along the arcuate portion.

Here, it is preferable that an interval between the grooves is determined in accordance with a tilt angle of a beam radiation in the vertical direction.

Further, it is preferable that the semicircular radial antenna further comprises extended portions protruded from a top face of an upper waveguide plate and a bottom face of a lower waveguide plate in the vertical direction, and extending along the arcuate portion of each waveguide plate, each extended portion being formed with at least one groove extending along the arcuate portion.

Here, it is preferable that the semicircular radial antenna further comprises a dielectric member formed along the peripheral face of the arcuate portion and a peripheral face of each extended portion.

Preferablly, the semicircular radial antenna further comprises a dielectric member formed along the peripheral face of the arcuate portion. Here, a peripheral face of the dielectric member is formed with a pluarilty of grooves extending along the arcuate portion at positions where are substantially opposing to the peripheral faces of the arcuate positions in the respective waveguide plates.

Here, it is preferable that an interval between the grooves is determined in accordance with a tilt angle of a beam radiation in the vertical direction.

Preferably, the semicircular radial antenna further comprises a dielectric member formed along the peripheral face of the arcuate portion. Here, a peripheral face of the dielectric member is formed with a plurality of metal strip lines extending along the arcuate portion at positions where are substantially opposing to the peripheral faces of the arcuate portions in the respective waveguide plates.

Here, it is preferable that an interval between the metal strip line is determined in accordance with a tilt angle of a beam radiation in the vertical direction.

According to the above configurations, the unnecessary backward radiation can be reduced and the gains can be enhanced.

In addition, changing the interval among the plural grooves suitably, the radiation beams can be tilted in the vertical direction.

Preferably, the semicircular radial antenna further comprises a combiner through which the semicircular radial antenna is connected with at least one semicircular radial antenna having the same configuration. Here, the combiner combines signals obtained from each feeder.

Here, it is preferable that the semicircular radial antenna further comprises a switch for selecting a signal outputted from the combiner or a signal obtained from the feeder of one semicircular radial antenna.

Further, it is preferable that the semicircular radial antenna further comprises a phase shifter which shifts a phase of a signal obtained from the feeder so as to receive a circularly polarized wave signal together with another semicircular radial antenna.

Still further, it is preferable that the semicircular radial antenna further comprises a phase shifter which shifts a phase of a signal obtained from the feeder so as to receive a linearly polarized wave signal together with another semicircular radial antenna.

Still further, it is preferable that the semicircular radial antenna further comprises:

- a first combiner, through which the semicircular radial antenna is connected with at least one semicircular radial antenna having the same configuration;
- a phase shifter which shifts a phase of a signal obtained from the feeder so as to receive a circularly polarized wave signal together with another semicircular radial antenna; and
- a second combiner, through which the semicircular radial antenna is connected with another semicircular radial antenna via the phase shifter.

Here, it is preferable that the semicircular radial antenna further comprises a branching filter which transmits a signal having a first frequency to the first combiner and a signal having a second frequency to the second combiner.

Alternatively, it is preferable that the semicircular radial antenna further comprises:

- a first combiner, through which the semicircular radial antenna is connected with at least one semicircular radial antenna having the same configuration;
- a phase shifter which shifts a phase of a signal obtained from the feeder so as to receive a linearly polarized wave signal together with another semicircular radial antenna; and
- a second combiner, through which the semicircular radial antenna is connected with another semicircular radial antenna via the phase shifter.

Here, it is preferable that the semicircular radial antenna further comprises a branching filter which transmits a signal having a first frequency to the first combiner and a signal having a second frequency to the second combiner.

Preferably, the semicircular radial antenna is connected with at least two semicircular radial antennas such that the semicircular radial antennas are circularly arranged at an equal interval.

Preferably, the semicircular radial antenna further comprises at least one second antenna for receiving a wave signal having a frequency higher than a frequency of a wave signal received by the semicircular radial antenna.

Preferably, the semicircular radial antenna further comprises at least two second semicircular antenna for receiving a wave signal having a frequency different from a frequency of a wave signal received by the semicircular antenna.

According to the above configurations, the multidirectivity can be attained by a single type of antenna. Furthermore, since the directivity can be switched as required, plural radio waves having different arriving directions can be received by the single type of antenna. Therefore, the antenna can be easily arranged even when an arranging area is narrow.

Preferably, the waveguide plates are provided as film substrates, and a flexible dielectric substance is placed between the waveguide plates.

DETAILED DESCRIPTION OF THE PREFERRED EMBODIMENTS

Preferred embodiments of the invention will now be described by reference to the accompanying drawings.

A semicircular radial antenna according to a first embodiment of the invention exemplifies a case where the width of a horizontal beam is set variably.

Figure 1:
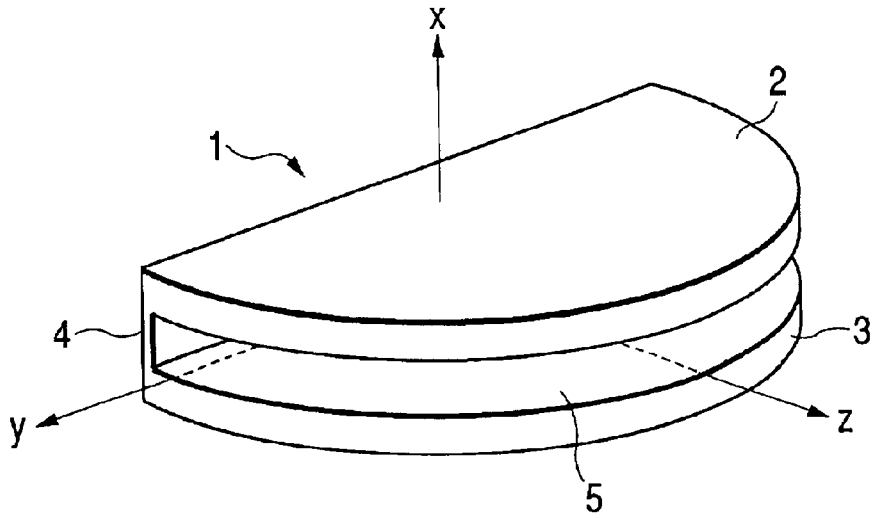
FIG. 1 is a perspective view of a semicircular radial antenna according to a first embodiment.

As shown in FIG. 1, the semicircular radial antenna 1 has an upper semicircular waveguide plate 2 and a lower semicircular waveguide plate 3. The waveguide plates 2 and 3 are arranged so as to mutually oppose and are spaced from each other at a predetermined interval of, e.g., $\lambda/4$ or less. Base portions of the upper and lower waveguide plates 2 and 3 (i.e., linear edges) are short-circuited by a short-circuit wall 4, thus constituting a semi-radial waveguide path 5 between the upper and lower waveguide plates 2 and 3. In other words, the semicircular radial waveguide path 5 is formed such that the base portion of the semicircular radial waveguide path 5 is short-circuited by the short-circuit wall 4 and such that a peripheral section of the semicircular radial waveguide path 5 is open.

Figure 4A:
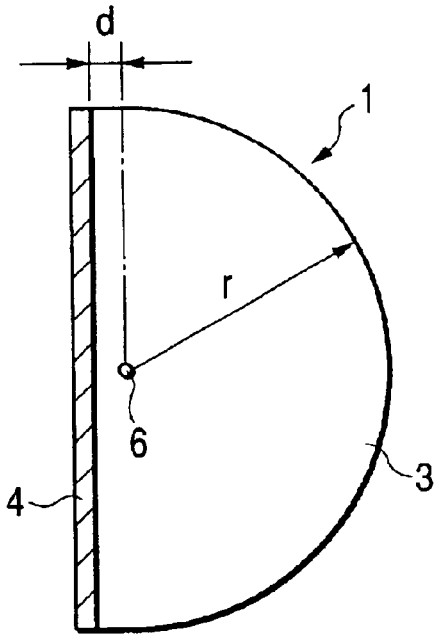
FIG. 4A is a transverse section view of the semicircular radial antenna according to the first embodiment.
Figure 4B:
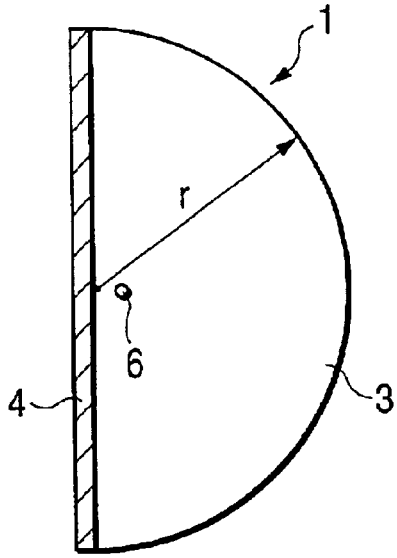
FIG. 4B is a transverse section view of a modified example of the semicircular radial antenna according to the first embodiment.
Figure 4C:
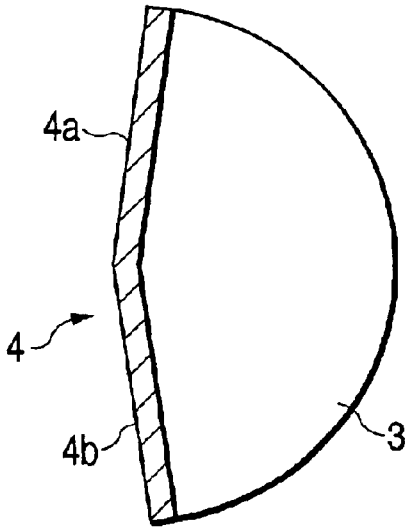
FIGS. 4C and 4D are schematic transverse section views showing modified examples of a semicircular waveguide plate and a short-circuit wall.
Figure 4D:
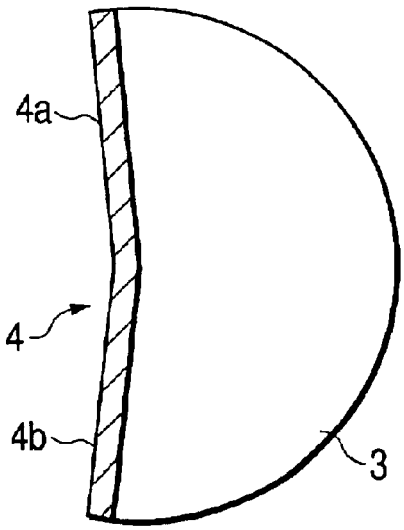

Here, the shape of waveguide plates 2, 3 may not be a complete semicircle as shown in FIGS. 1, 4A and 4B. In other words, the short-circuit wall 4 may not be straight completely. As shown in FIGS. 4C and 4D, respective parts 4*a*, 4*b* of the short-circuit wall 4 substantially defining the radius of the waveguide plates 2, 3 may be angled with each other. Furthermore, the respective parts 4*a*, 4*b* of the short-circuit wall 4 may be curved if the required beam radiation characteristic is obtained.

Figure 2:
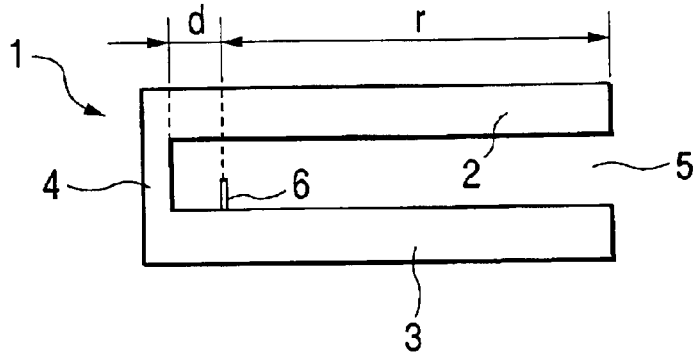
FIG. 2 is a vertical section view of the semicircular radial antenna according to the first embodiment.

As shown in FIG. 2, a feeder (probe) 6 is provided at the center position on the lower waveguide 3 spaced a given interval "d," e.g., $\lambda/4$, from the short-circuit wall 4. The upper waveguide plate 2 and the lower waveguide 3 are each formed into the shape of a semi-circle of radius "r." The value of radius r is set to about $2\lambda$.

Figure 3:
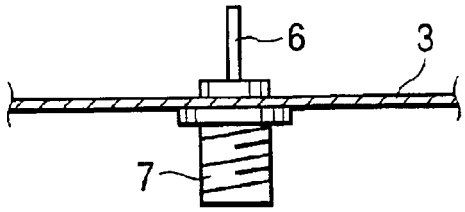
FIG. 3 is a view showing a feeder of the antenna according to the first embodiment.

A coaxial connector 7 such as that shown in FIG. 3 is used for the feeder 6. A power feeding pin is provided so as to project from the center of the coaxial connector 7 to the inside of the semicircular radial waveguide path 5.

The center of curvature of the upper semicircular waveguide plate 2 and that of the lower semicircular waveguide plate 3 are set at arbitrary positions within the range between the position of the feeder 6 and the short-circuit wall 4. The width of a horizontal beam changes in accordance with variable setting of the center of curvature of the upper waveguide plate 2 and that of the lower waveguide plate 3.

As shown in FIG. 4A, the center of curvature of the upper waveguide 2 and that of the lower waveguide 3 are aligned with the position of the feeder 6. When the interval d between the center of curvature and the short-circuit wall 4 is set to $\lambda/4$, the half width of the horizontal beam will become approximately 140° as shown in FIG. 5.

Figure 6:
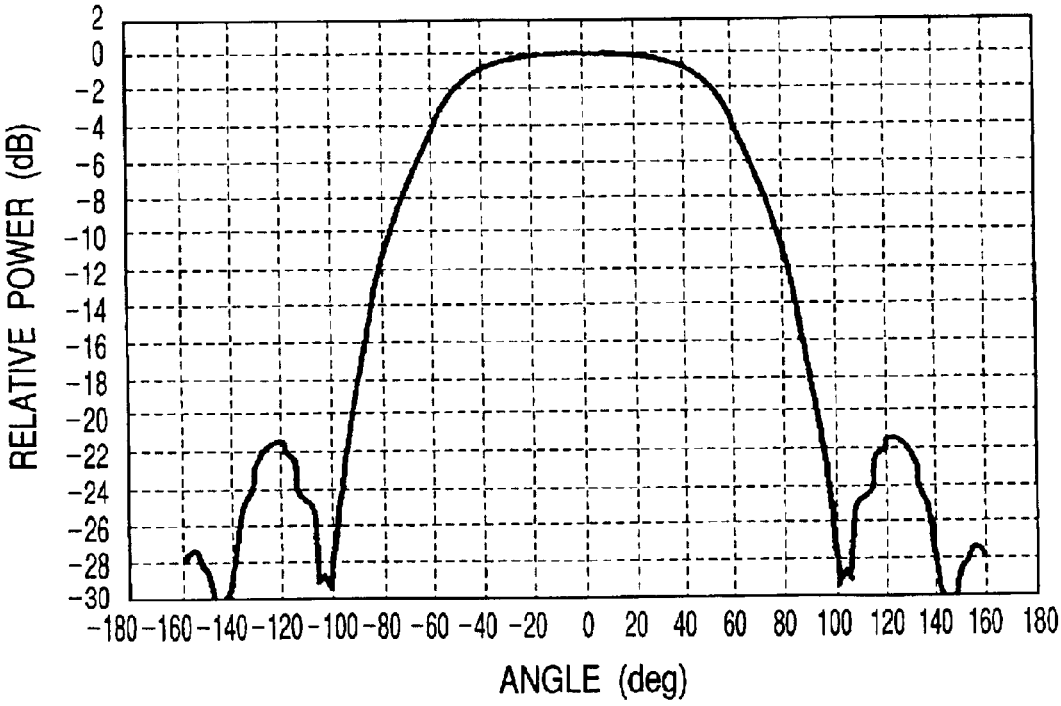
FIG. 6 shows a horizontal-plane radiation pattern of the semicircular radial antenna of the semicircular antenna shown in FIG. 4B.

As shown in FIG. 4B, when the center of curvature of the upper waveguide plate 2 and that of the lower waveguide plate 3 are set to the position of the short-circuit wall 4, the half width of the horizontal beam will become approximately 110° as shown in FIG. 6.

Figure 5:
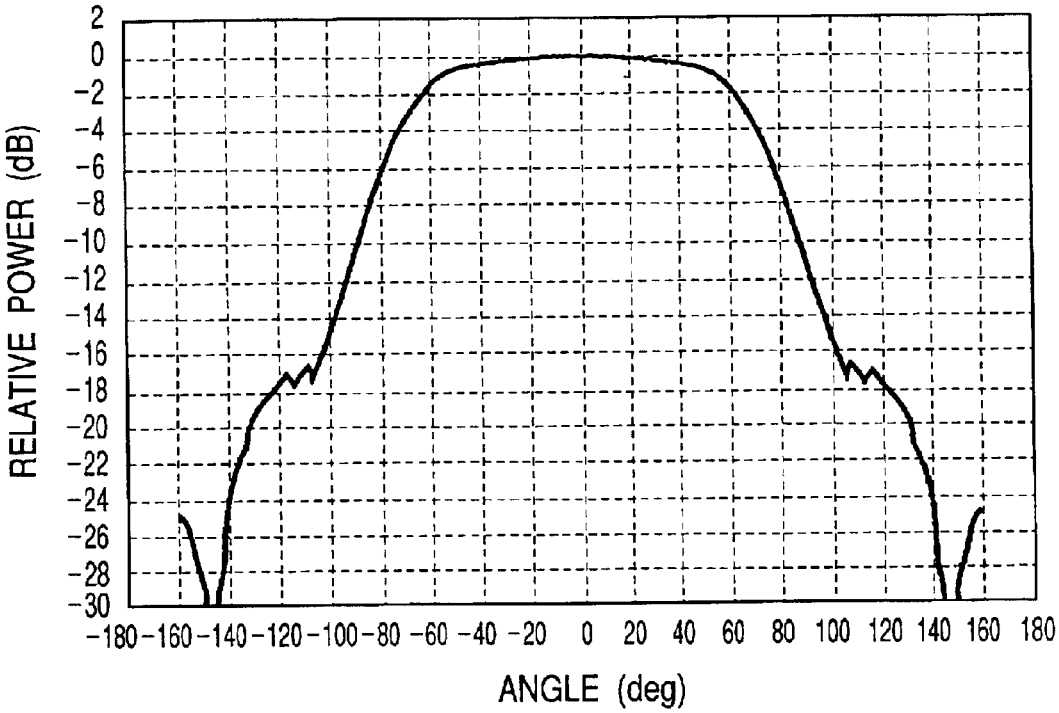
FIG. 5 shows a horizontal-plane radiation pattern of the semicircular radial antenna of the semicircular antenna shown in FIG. 4A.

In FIGS. 5 and 6, there are shown horizontal-plane radiation patterns when a center receiving frequency of the semicircular radial antenna 1 is set to 26 GHz, while angles (deg.) are taken as the horizontal axis and the relative power (dB) is taken as the vertical axis.

The center of curvature of the upper waveguide plate 2 and that of the lower waveguide plate 3 are adequately selected between the feeder 6 and the short-circuit wall 4 in accordance with a desired horizontal beam radiation width.

Next, there will now be described a semicircular radial antenna wherein the orientation of a vertical radiation beam is variably set.

Figure 7:
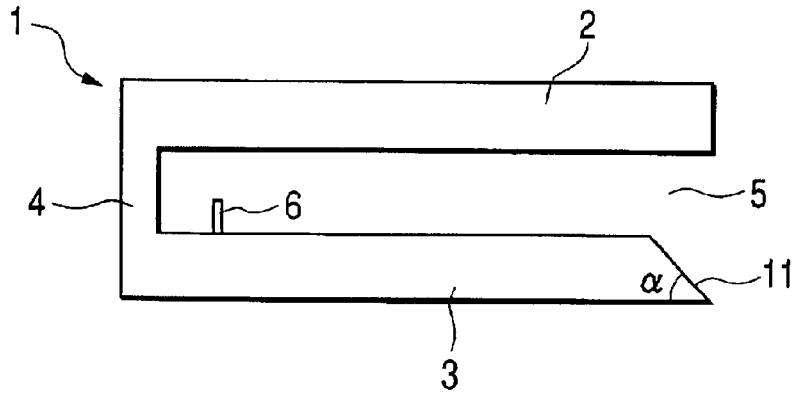
FIG. 7 is a vertical section view showing a semicircular radial antenna according to a second embodiment.

FIG. 7 shows a semicircular radial antenna according to a second embodiment. In this embodiment, a tapered section 11 is formed in an inner area of an outer peripheral face of the lower waveguide plate 3 so that a vertical radiation beam is oriented downward at a predetermined angle. In other respects, the semicircular radial antenna 1 is identical in construction with that shown in FIG. 1, and hence detailed explanations thereof are omitted.

By changing an angle $\alpha$ of the tapered section 11 suitably, the downward angle of the vertical radiation beam can be selected.

Figure 8:
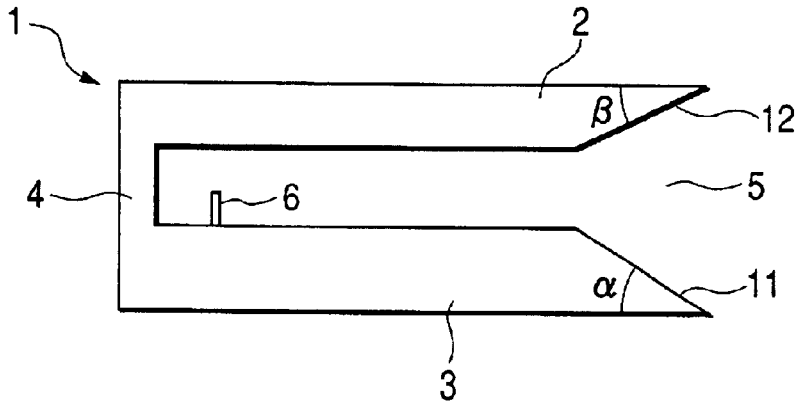
FIG. 8 is a vertical section view showing a semicircular radial antenna according to a third embodiment.

FIG. 8 shows a semicircular radial antenna according to a third embodiment, wherein the tapered section 11 is formed in the inner area of the outer peripheral face of the lower waveguide plate 3 and a tapered section 12 is formed in an inner area of the outer peripheral face of the upper waveguide plate 2. Further, the angle $\alpha$ of the tapered section 11 is set so as to become greater than an angle $\beta$ of the tapered section 12.

The tapered section 11 is formed in the lower waveguide plate 3, and the tapered section 12 is formed in the upper waveguide plate 2. By setting a difference between the angles $\alpha$ and $\beta$ suitably, the downward angle of the vertical radiation beam can be selected in accordance with the difference in angle.

Figure 9:
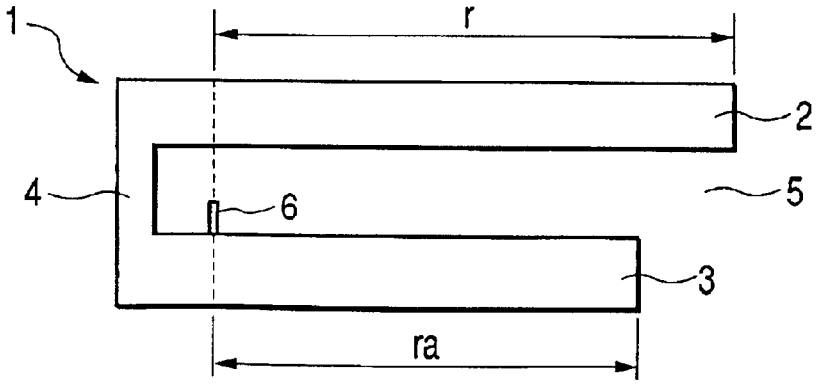
FIG. 9 is a vertical section view showing a semicircular radial antenna according to a fourth embodiment.

FIG. 9 shows a semicircular radial antenna according to a fourth embodiment in which the upper waveguide plate 2 is formed so as to assume a radius "r" and the lower waveguide plate 3 is formed so as to assume a radius "ra."

By forming the upper and lower waveguide plates 2 and 3 such that the radius ra becomes shorter than the radius r, the downward angle of the vertical radiation beam can be variably set in accordance with a radial difference. For example, if the upper waveguide plate 2 has been formed so as to assume a radius r of $2\lambda$ and the lower waveguide plate 3 has been formed so as to assume a radius ra of $1.5\lambda$, the vertical radiation beam can be oriented downward at an angle of approximately 45°.

Figure 10:
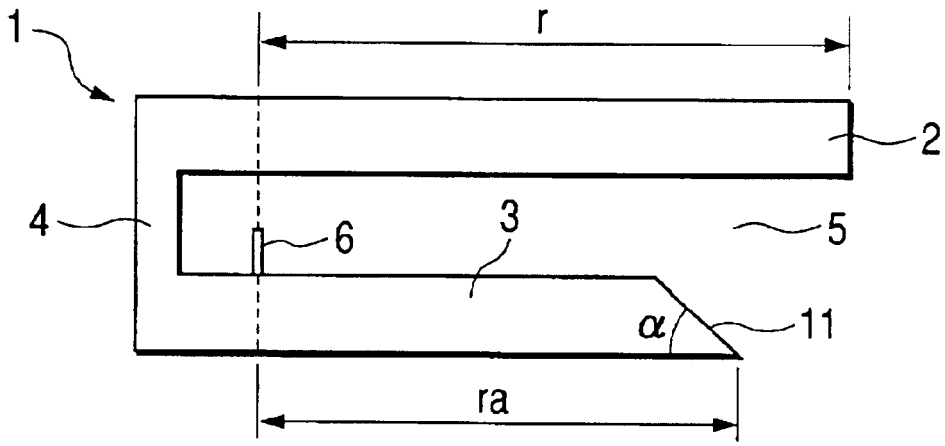
FIG. 10 is a vertical section view showing a semicircular radial antenna according to a fifth embodiment.

FIG. 10 shows a semicircular radial antenna according to a fifth embodiment in which the upper and lower waveguide plates 2 and 3 are formed such that the radius ra becomes shorter than the radius r and such that the tapered section 11 is formed in the inner area of the outer peripheral face of the lower waveguide plate 3 in the manner shown in FIG. 7.

By forming the tapered section 11 in the inner area of the outer peripheral face of the lower waveguide plate 3 that has been formed to be short, the desired angle of the vertical radiation beam can be set with greater reliability.

Figure 11:
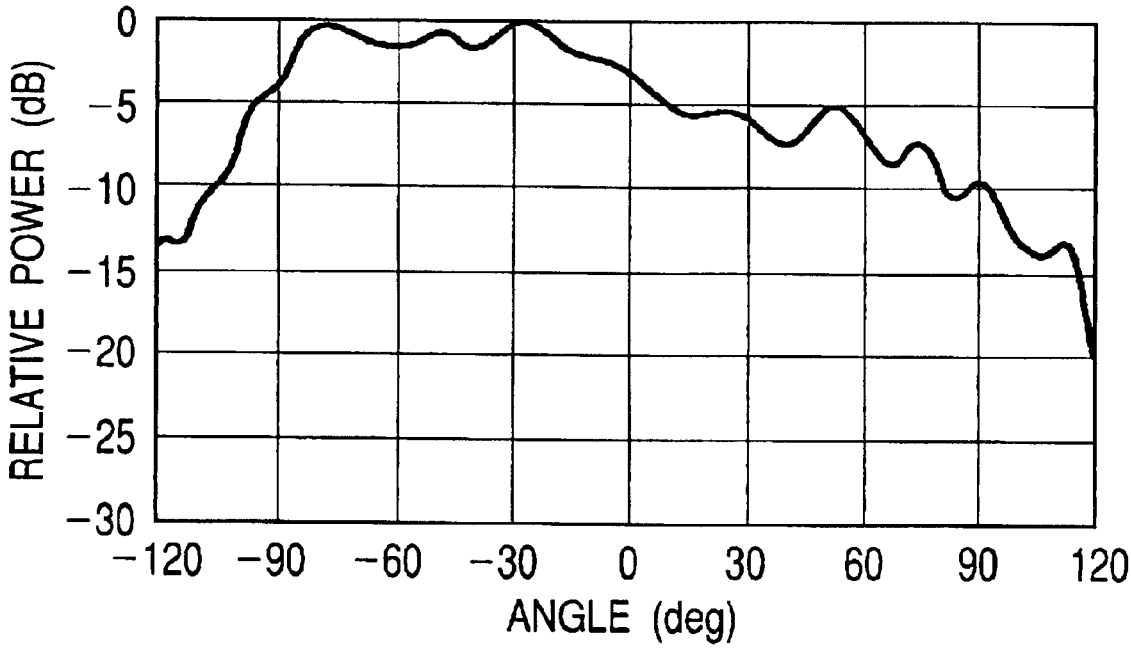
FIG. 11 is a view showing a vertical-plane radiation pattern of the semicircular radial antenna shown in FIG. 10.

FIG. 11 shows a vertical-plane radiation pattern of the semicircular radial antenna 1 shown in FIG. 10 obtained when the radius "r" of the upper waveguide plate 2 is set to 30 mm; the radius ra of the lower waveguide plate 3 is set to 25 mm; a distance L between the feeder 6 and the inner edge of the tapered section 11 is set to 22 mm; and the center receiving frequency of the semicircular radial antenna 1 is set to 26 GHz. An angle at which the beam is to be radiated (deg.) is taken as the horizontal axis and the relative power (dB) is taken as the vertical axis. In relation to the angle (deg.) of a radiated beam taken on the horizontal axis, an angle of 0° represents the lateral front direction, and a negative value (−) represents a downward angle.

As is evident from the vertical-plane radiation pattern shown in FIG. 11, in the semicircular radial antenna 1 described in connection with the embodiment shown in FIG. 10, the gain of the antenna rises within the range from about −25° to −80°, and a vertically-radiated beam is seen to be oriented downward.

The vertical radiation beam can be oriented downward by forming the upper and lower waveguide plates 2 and 3 such that the radius ra becomes shorter than the radius r. The downward angle of the vertical radiation beam can be changed, by suitably selecting the radius ra of the lower waveguide plate 3.

The semicircular radial antenna according to the second through the fifth embodiments can be used as an antenna for use with a portable cellular phone in, e.g., a parking area in a building, and exhibit high performance. More specifically, when an antenna for a portable cellular phone is set in a building, the antenna is set at the highest possible position, such as a higher position on a wall. Hence, the radiation angle of a vertical radiation beam must be oriented downward. In such a case, the semicircular radial antenna of the invention enables arbitrary, variable setting of a radiating direction of a vertical radiation beam. Further, the width of a horizontal beam can be set arbitrarily in accordance with the size of a parking area. Hence, the semicircular radial antenna can exhibit high performance.

Figure 12:
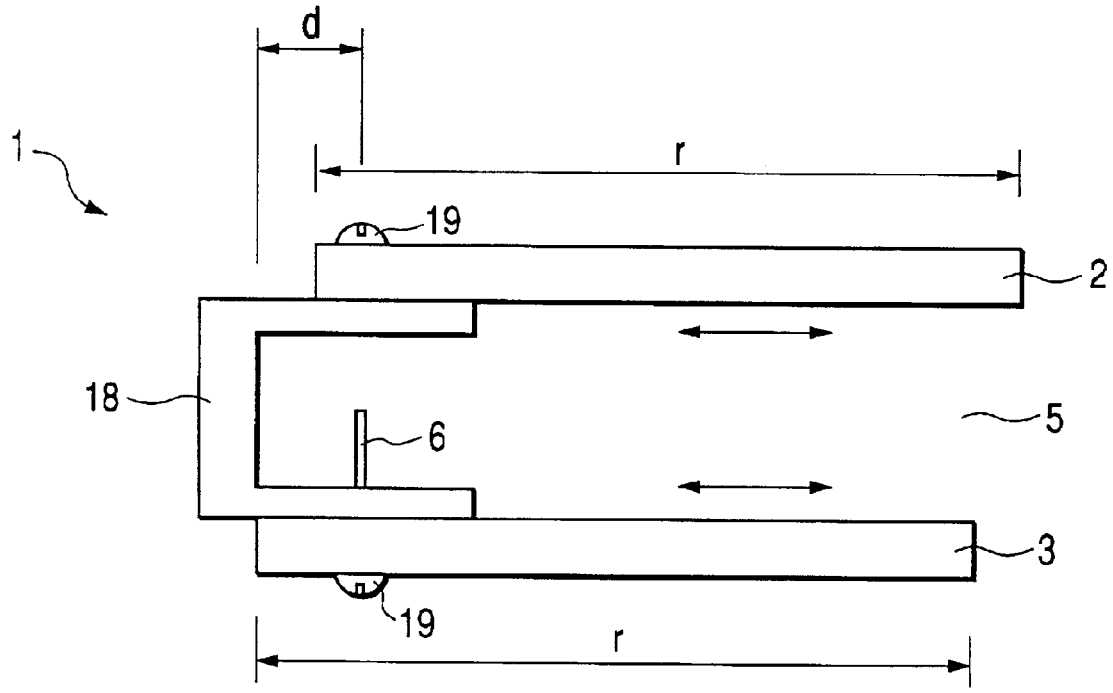
FIG. 12 is a vertical section view showing a semicircular radial antenna according to a sixth embodiment.

FIG. 12 shows a semicircular radial antenna according to a sixth embodiment of the invention. In this embodiment, it is configured such that the position of the center of curvature can be changed in accordance with the desired horizontal beam radiation characteristic.

Specifically, a semicircular upper waveguide plate 2 and a semicircular lower waveguide plate 3 each having a radius of curvature r are slidably fixed on a connection member 18 by fixation members 19. The connection member serves as a short-circuit wall. By forming a slot, through which the fixation member passes on each waveguide plate, the center of curvature can be selected between the connection member 18 and a feeder 6 (i.e., within a range designated by d).

Although screws are illustrated as the fixation members 19, any kinds of member may be adopted if the waveguide plates 2, 3 are suitably fixed on the connection member 18.

Figure 13:
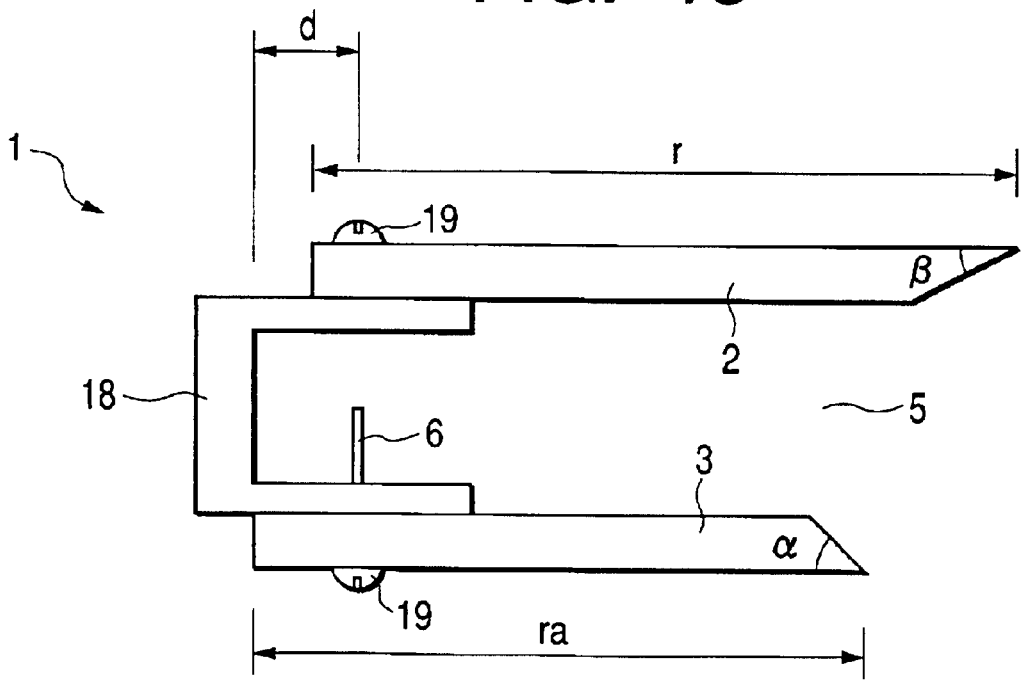
FIG. 13 is a vertical section view showing a semicircular radial antenna according to a seventh embodiment.

FIG. 13 shows a semicircular radial antenna according to a seventh embodiment. In this embodiment, at least one of the position of the center of curvature, the curvature radius, the tapered angle of the outer peripheral face of each waveguide plate can be selected in accordance with a desired horizontal beam radiation characteristic and a desired vertical beam orientation.

Specifically, a semicircular upper waveguide plate 2 wherein the curvature radius r and the tapered angle β are previously selected is fixed on a top face of a connection member 18 by a fixation member 19 such that the center of radius is placed at a desired position between the connection member 18 and a feeder 6 (i.e., within a range designated by d).

On the other hand, a semicircular lower waveguide plate 3 wherein the curvature of radius ra and the tapered angle α are previously selected is fixed on a bottom face of the connection member 8 by a fixation member 19 such that the center of radius is placed at a desired position between the connection member 18 and the feeder 6.

Here, as well as the sixth embodiment shown in FIG. 12, the respective waveguide plates may be slidably fixed on the connection member 18 such that the position of the center of radius can be adjusted.

A semicircular radial antenna according to an eighth embodiment will be described with reference to FIGS. 14 through 18D.

Figure 14:
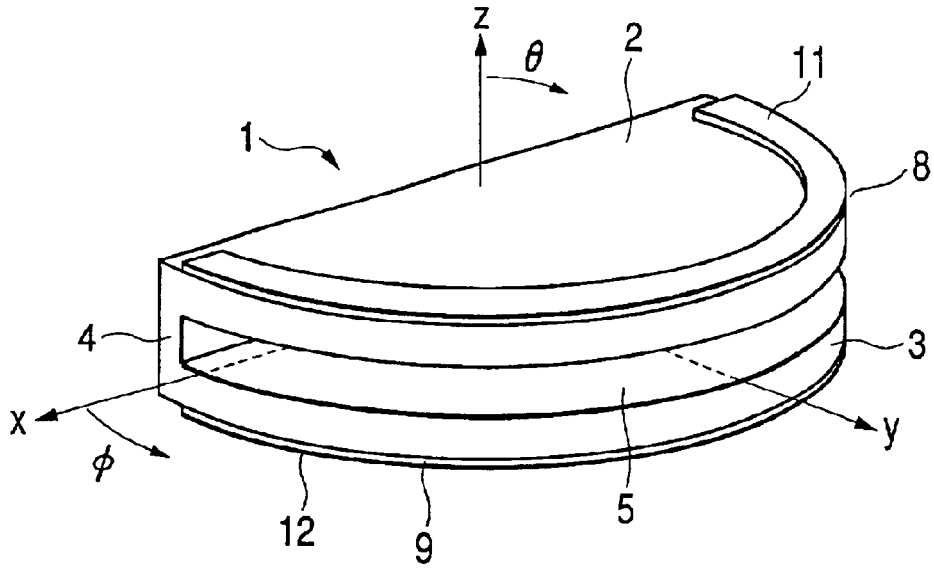
FIG. 14 is a perspective view showing a semicircular radial antenna according to an eighth embodiment.

As indicated in FIG. 14, in the semicircular radial antenna 1, a semicircular upper waveguide plate 2 is positioned opposite to a semicircular lower waveguide plate 3 while maintaining a predetermined interval between these waveguide plates, for example, an interval "s" defined by approximately 0.25λ (λ/4). Also, base portions (straight edge portions) of these waveguide plates are short-circuited by a short-circuit wall 4 having a thickness "t", so that a semicircular radial waveguide path 5 is constituted between the upper waveguide plate 2 and the lower waveguide plate 3. In other words, this semicircular radial waveguide path 5 is formed under such a condition that a base portion thereof is short-circuited by the short-circuit wall 4, and a circumferential portion thereof is opened. A thickness "B" of the upper waveguide plate 2 and a thickness "B" of the lower waveguide plate 3 are set to approximately 0.23λ, and a thickness "t" of the short-circuit wall 4 is set to approximately 0.08λ.

Figure 16:
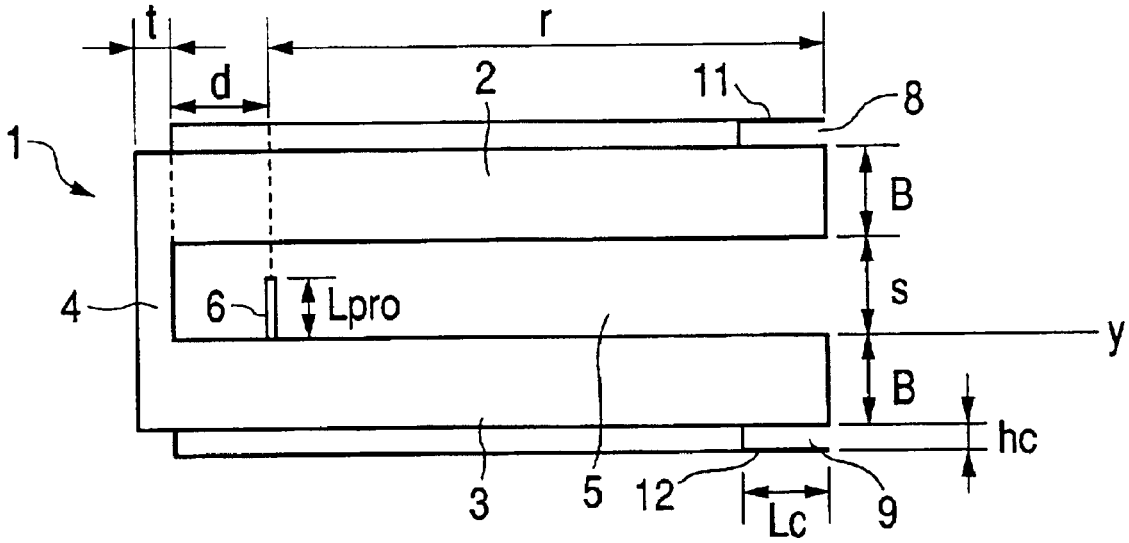
FIG. 16 is a vertical section view showing the semicircular radial antenna according to the eighth embodiment.

Also, both horseshoe-shaped groove forming plates 11 and 12 are mounted along outer circumferential edges on both an upper face of the upper waveguide plate 2 and a lower face of the lower waveguide plate 3, while maintaining a predetermined interval between these groove forming plates 11 and 12, so as to form grooves 8 and 9. In this case, base portions of the groove forming plates 11 and 12 are mounted on the upper waveguide plate 2 and the lower waveguide plate 3, so that bottom portions of the grooves 8 and 9 are short-circuited. In other words, as indicated in FIG. 16, the grooves 8 and 9 are formed in both the upper face of the upper waveguide plate 2 and the lower face of the lower waveguide plate 3, while a depth of each of the grooves 8 and 9 is "Lc", a height of each of the grooves 8 and 9 is "hc", and a front face of each of the grooves 8 and 9 is opened. The depth "Lc" and the height "hc" of each of the grooves 8 and 9 are set to approximately 0.25λ and approximately 0.08λ, respectively.

Figure 15:
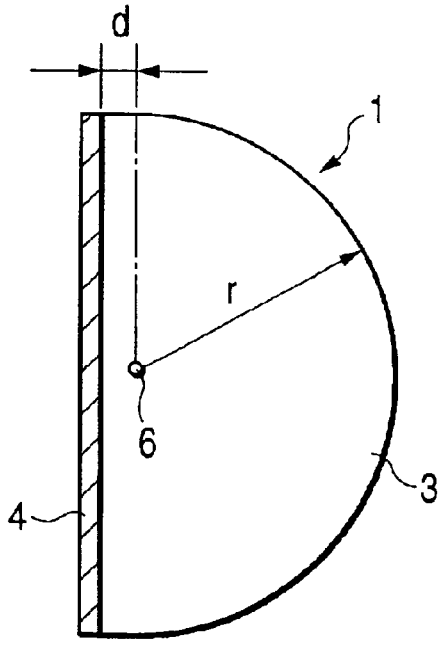
FIG. 15 is a transverse section view for indicating the semicircular radial antenna according to the eighth embodiment.

Then, as shown in FIG. 15, a feeder (probe) 6 is provided on the lower waveguide plate 3 at a center position separated from the short-circuit wall 4 by a constant interval "d", for instance, λ/4. While each of the upper waveguide plate 2 and the lower waveguide plate 3 is formed in a semicircular shape having a radius "r", a value of this radius "r" is set to approximately 2λ.

Figure 17:
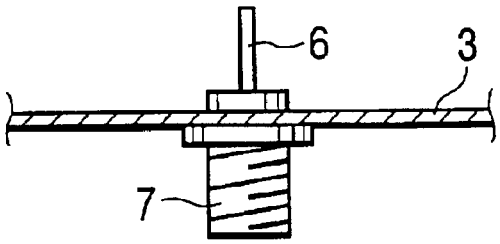
FIG. 17 is a view showing a feeder of the antenna according to the eighth embodiment.

As the above-described feeder 6, for example, a coaxial connector 7 as indicated in FIG. 17 is used. A feeding pin is provided in such a manner that the feeding pin is projected from a center portion of the lower waveguide plate 3 inside the semicircular radial waveguide path 5. A projection length of this feeding pin is set to approximately 0.175λ.

In this embodiment, since the grooves 8 and 9 are provided on the outer sides of both the upper waveguide 2 and the lower waveguide 3, unnecessary radiation to backward areas can be blocked due to choke effects achieved by the grooves 8 and 9, so that the antenna gain can be improved.

Figure 18A:
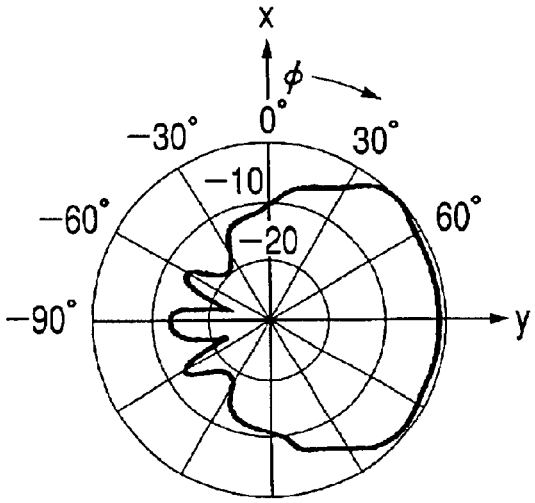
FIGS. 18A and 18B are diagrams indicating radiation characteristics of a semicircular radial antenna in which choke-effect grooves are not provided.
Figure 18B:
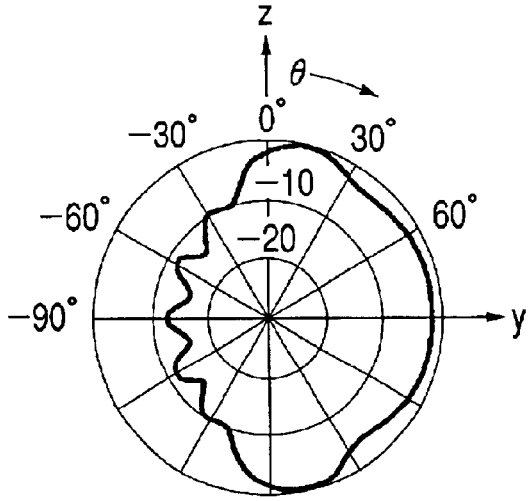
Figure 18C:
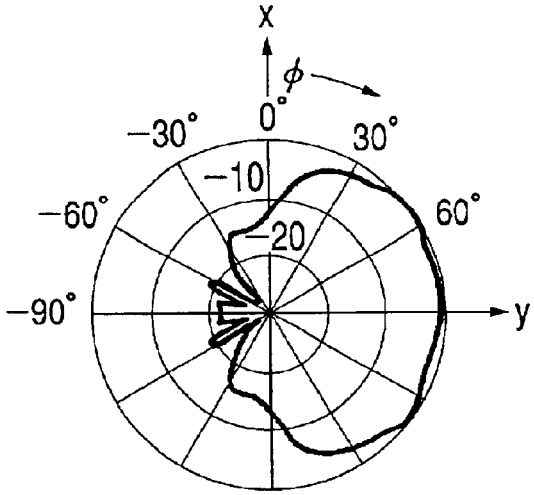
FIGS. 18C and 18D are diagrams indicating radiation characteristics of a semicircular radial antenna according to the eighth embodiment.
Figure 18D:
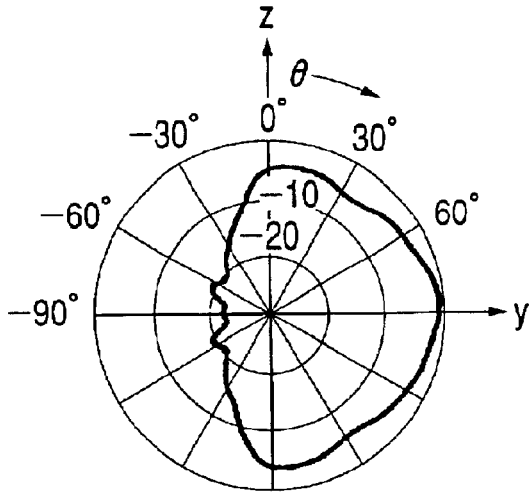

FIGS. 18A and 18B represent radiation characteristics of a semicircular radial antenna in which the grooves 8 and 9 are not provided, whereas FIGS. 18C and 18D show radiation characteristics of the semicircular radial antenna 1 in which the grooves 8 and 9 are provided. In this case, assuming now that a receiving frequency of the semicircular radial antenna 1 is selected to be 12.5 GHz (wavelength "λ"=24.0 mm), dimensions of the respective portions are set as follows:

r=2.08λ,
d=0.25λ,
t=0.08λ,
B=0.23λ,
hc=0.08λ,
Lc=0.20λ,
Lpro=0.175λ.

Also, as indicated in FIGS. 14 and 15, the radiation characteristics of FIG. 18 are represented, assuming now that a direction which passes through a feeding point (origin) and is directed in parallel to the short-circuit wall 4 of the antenna is defined as an "x axis"; a front direction perpendicular to this x axis is defined as a "y axis"; and a direction which is directed from an origin of the y axis to a vertical direction is defined as a "z axis." Then, FIGS. 18A and 18C represent radiation characteristics "Eϕ" of the horizontal plane, assuming now that an angle directed from the x axis to the y axis is defined as "ϕ", whereas FIGS. 18B and 18D show radiation characteristics "θ" of the vertical plane, assuming now that an angle directed from the z axis to the y axis is defined as "θ."

As apparent from the above-described radiation characteristics of FIG. 18, since the grooves 8 and 9 are formed in both the upper face of the upper waveguide plate 2 and the lower face of the lower waveguide plate 3, it can be understood that the unnecessary backward radiation (namely, −y axial area) is reduced. As a consequence, the gain as to the antenna forward areas can be increased.

Next, a ninth embodiment of the present invention will be described with reference to FIGS. 19 through 21B.

Figure 19:
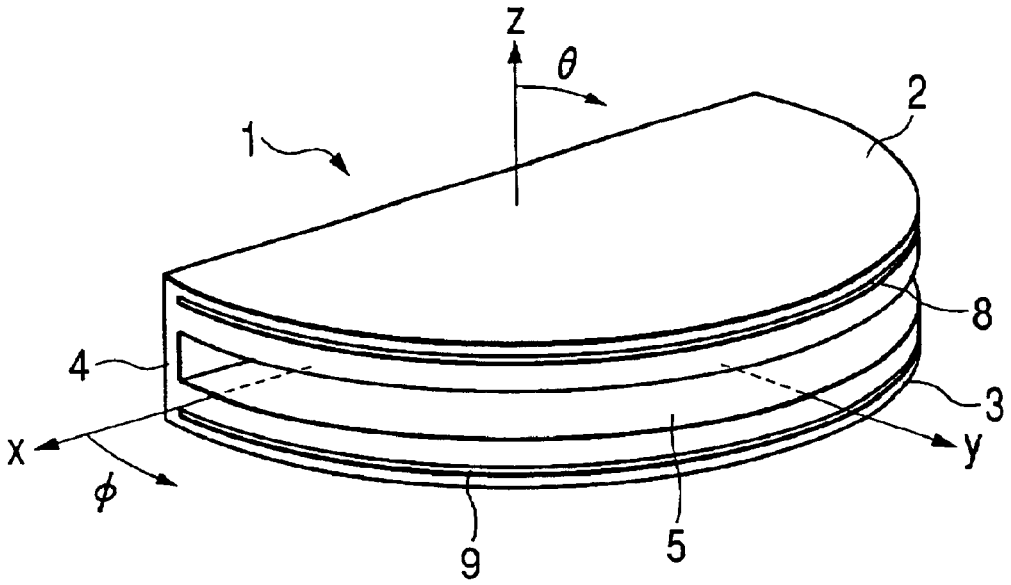
FIG. 19 is a perspective view showing a semicircular radial antenna according to a ninth embodiment.
Figure 20:
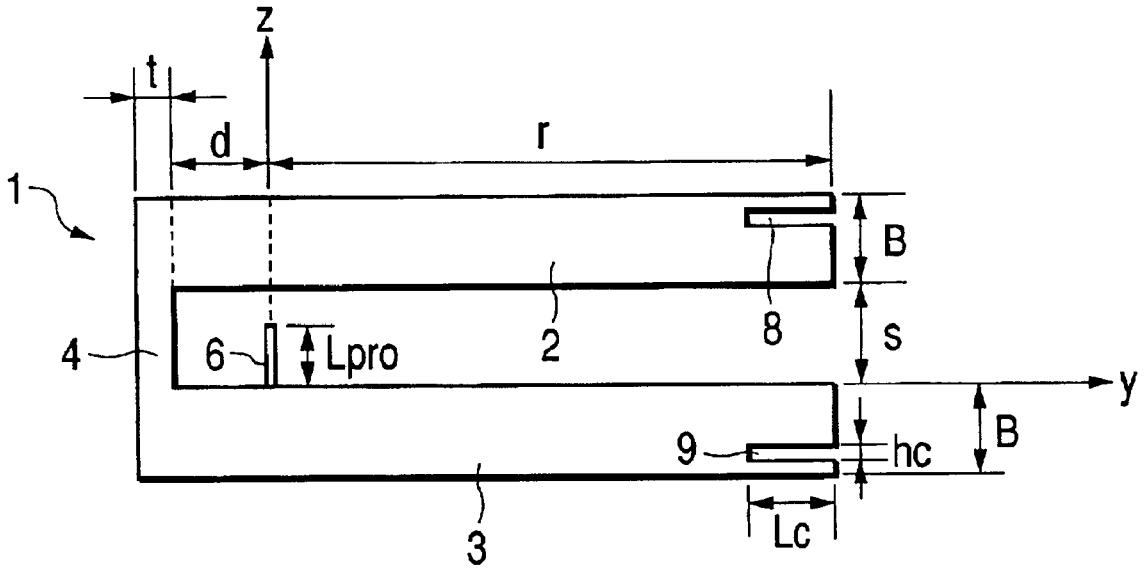
FIG. 20 is a vertical section view showing the semicircular radial antenna according to the ninth embodiment.

The semicircular radial antenna 1 according to this embodiment is to form grooves 8 and 9 in such a manner that, as indicated in FIGS. 19 and 20, grooves are formed along an outer circumferential face (front edge plane) of an upper waveguide plate 2, and also, an outer circumferential face (front edge plane) of a lower waveguide plate 3. In this case, a depth "Lc" and a height "hc" of each of the grooves 8 and 9 are set to such values similar to those of the above-described eighth embodiment. Also, the groove 8 is provided in proximity to the upper face of the upper waveguide plate 2, and the groove 9 is provided in proximity to the lower face of the lower waveguide plate 3.

Figure 21A:
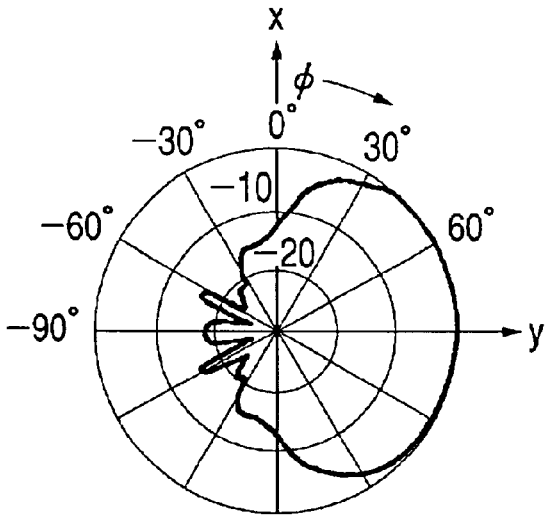
FIGS. 21A and 21B is a diagram indicating a radiation characteristic of the semicircular radial antenna according to the ninth embodiment.
Figure 21B:
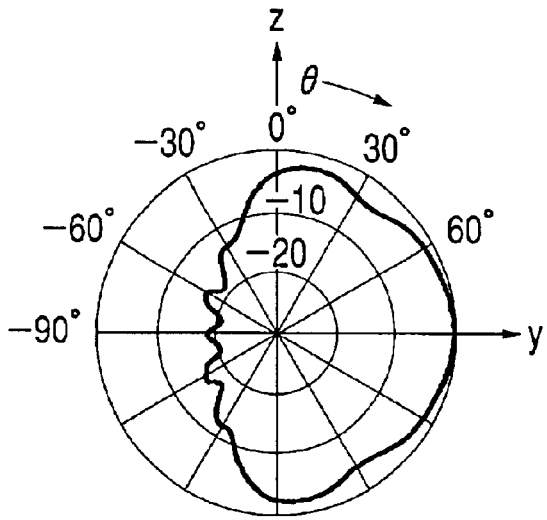

FIGS. 21A and 21B represent a radiation characteristic of the semicircular radial antenna 1 according to this embodiment. In other words, FIG. 21A is a radiation characteristic "Eϕ" of the horizontal plane, assuming now that an angle directed from the x axis to the y axis is defined as "ϕ", whereas FIG. 21B shows a radiation characteristic "Eθ" of the vertical plane, assuming now that an angle directed from the z axis to the y axis is defined as "θ." It should be understood that the radiation characteristics of FIG. 21 are represented in such a case that dimensions of the respective portions of the semicircular radial antenna 1 are set to the same values of the eighth embodiment.

Similar to the case of the eighth embodiment, also, in the semicircular radial antenna 1 according to this embodiment, the unnecessary backward radiation (namely, −y axial area) is reduced, so that the gain as to the antenna forward areas can be increased.

Figure 22:
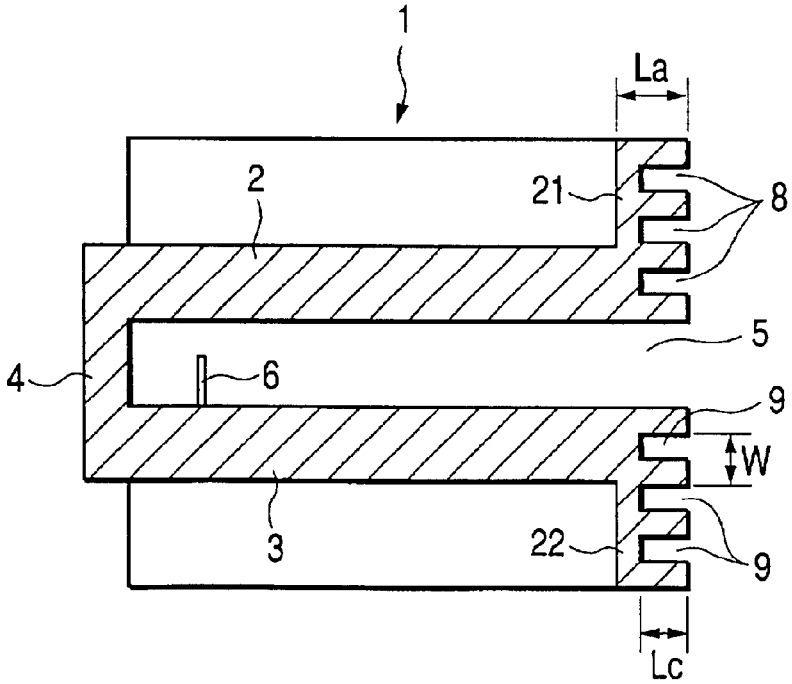
FIG. 22 is a vertical section view showing a semicircular radial antenna according to a tenth embodiment.

FIG. 22 shows a semicircular radial antenna according to a tenth embodiment of the present invention.

This embodiment is realized by that both a front edge portion of an upper waveguide plate 2 and a front edge portion of a lower waveguide plate 3 are extended along upper/lower directions so as to constitute extended portions 21 and 22, and a plurality of grooves 8 and 9 are formed in outer circumferential faces of these extended portions 21 and 22. A width "La" of each of the extended portions 21 and 22 is made slight larger than a depth "Lc" of each of the grooves 8 and 9. A height of each of the above-described extended portions 21 and 22 is set in accordance with total numbers of the grooves 8 and 9 to be formed. A total number of each of these grooves 8 and 9 is effectively selected to be 2 through approximately 10. Also, a period "W" of each of these grooves 8 and 9 is approximately λ.

According to the above configuration, unnecessary backward radiation (namely−y axial areas) can be more firmly reduced due to the choke effects achieved by the grooves 8 and 9, so that gains to the antenna forward areas can be furthermore increased.

Figure 23:
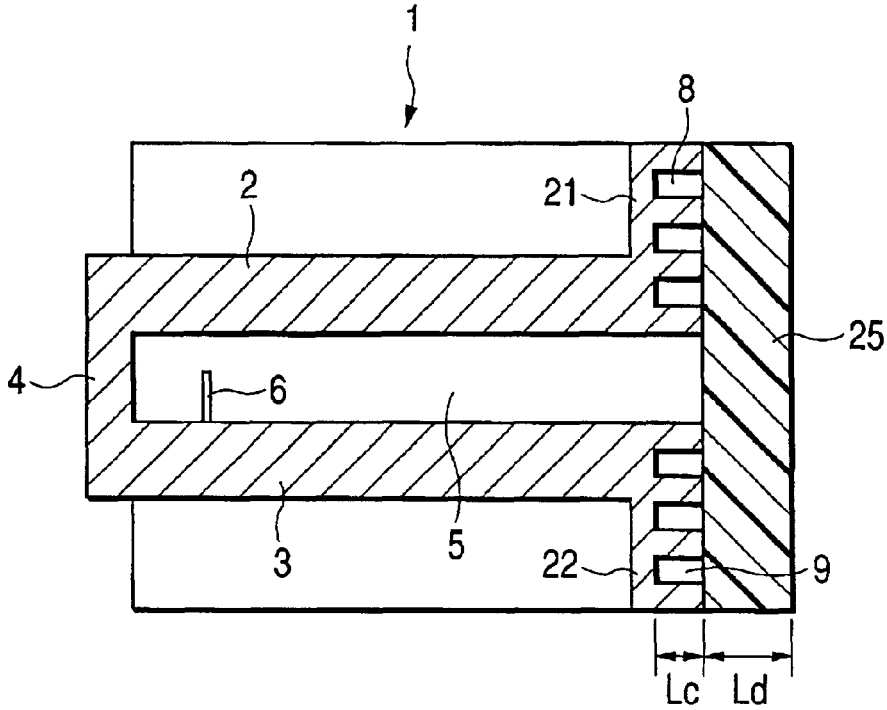
FIG. 23 is a vertical section view showing a semicircular radial antenna according to an eleventh embodiment.

FIG. 23 shows a semicircular radial antenna according to an eleventh embodiment of the present invention. This embodiment is realized by that as to tenth embodiment shown in FIG. 22, a dielectric substance 25 whose thickness "Ld" is approximately λ/2 or more is provided on the front face side of the semicircular radial antenna 1, namely a front face side of a semicircular radial waveguide path 5, and also, front face sides of the extended portions 21 and 22. In this case, symbol "λ" is defined by the following equation.

$$\lambda=\lambda_0/\sqrt{\epsilon_r} \quad (1)$$

It should be noted that the above-described symbol "$\lambda_0$" is a free spatial wavelength, and symbol "$\epsilon_r$" shows a dielectric constant of the dielectric substance 25.

According to the above configuration, the dielectric substance 25 may constitute a dielectric line, so that electromagnetic waves which are directed from the semicircular radial waveguide path 5 via the dielectric substance 25 to upper/lower directions is increased. The currents of the electromagnetic waves which pass through the dielectric substance 25 and are directed to the upper/lower directions are cut by the grooves 8 and 9 which are formed in the extended portions 21 and 22, so that the electromagnetic waves are radiated along a front direction. As a result, radiation beams along the front direction are increased, and thus, gains can be increased.

It should also be noted that FIG. 23 shows such a case that no dielectric substance is filled into the grooves 8 and 9. Alternatively, it is apparent that such a dielectric substance may be filled into the grooves 8 and 9. In this alternative case, dimensions of the grooves 8 and 9 may be calculated, while considering a wavelength shortening ratio caused by the dielectric substance. In other words, as explained above, the wavelength "λ" may be calculated as the equation (1).

Figure 24:
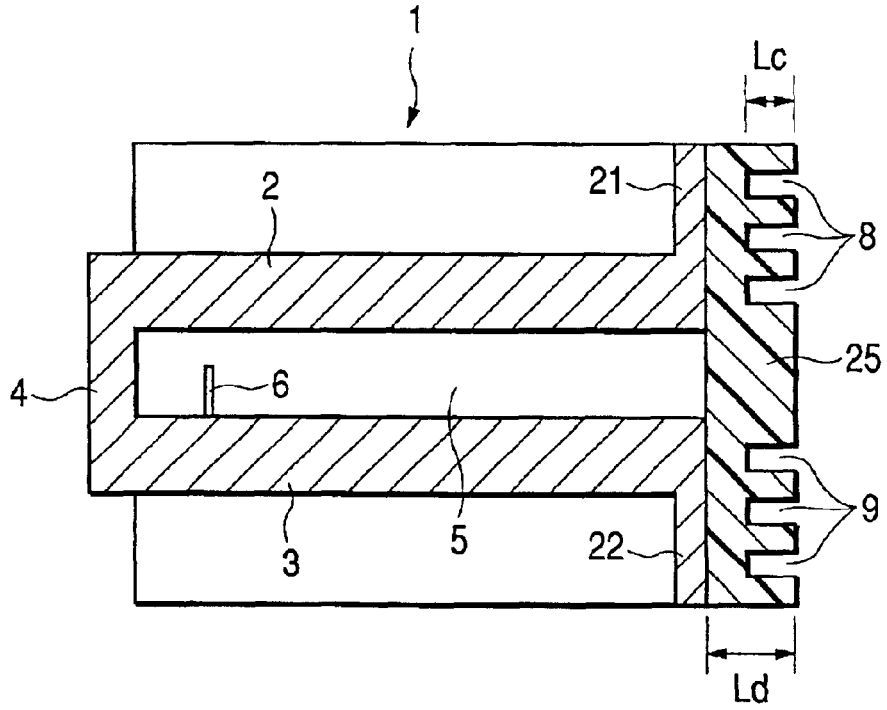
FIG. 24 is a vertical section view showing a semicircular radial antenna according to a twelfth embodiment.

FIG. 24 shows a semicircular radial antenna according to a twelfth embodiment of the present invention. In the above-described eleventh embodiment, the grooves 8 and 9 are provided in the extended portion 21 and 22, whereas in this embodiment, grooves 8 and 9 are provided in a front face of a dielectric substance 25.

As previously explained, since the grooves 8 and 9 are formed in the front face side of the dielectric substance 25, an impedance within the dielectric substance 25 is changed and a transfer mode is disturbed to radiate electromagnetic waves. As a consequence, such electromagnetic waves which are directed from a semicircular radial waveguide path 5 via the dielectric substance 25 to the upper/lower directions may be radiated along the front direction due to the disturbance of the transfer mode of the grooves 8 and 9. As a result, radiation beams to the front direction can be increased and gains can be improved.

Figure 25:
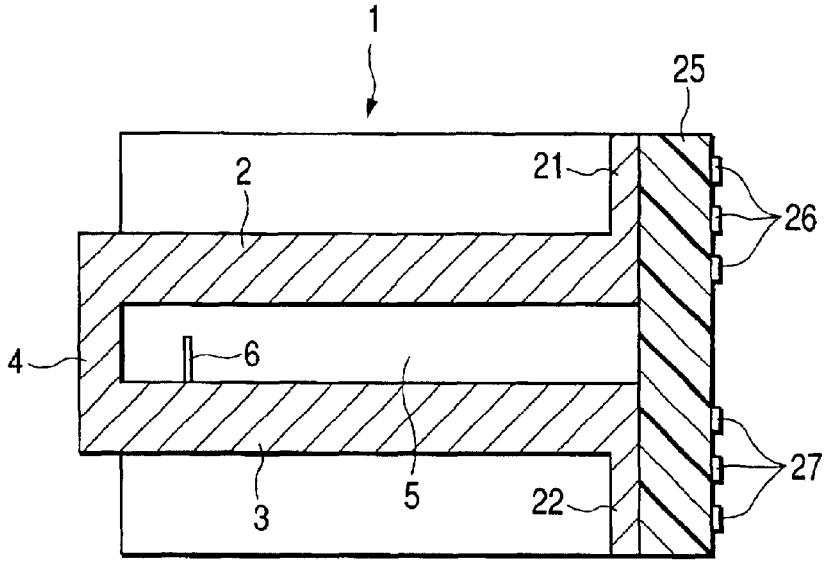
FIG. 25 is a vertical section view showing a semicircular radial antenna according to a thirteenth embodiment.
Figure 26:
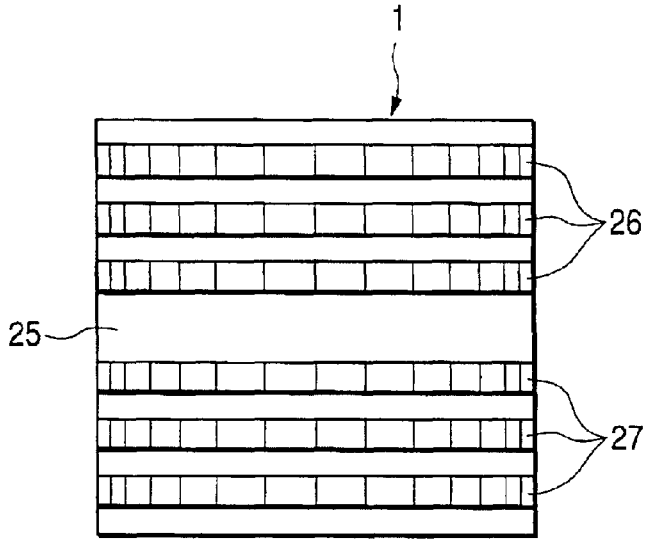
FIG. 26 a front view showing the semicircular radial antenna according to the thirteenth embodiment.

FIGS. 25 and 26 show a semicircular radial antenna according to a thirteenth embodiment of the present invention. This embodiment is realized by that metal strip lines 26 and 27 are provided on a front face of a dielectric substance 25, instead of the grooves 8 and 9, by way of, for example, a vapor deposition method, or the like. Since a period of each of the above-described metal strip lines 26 and 27 is set to approximately λ, such electromagnetic waves which are directed from a semicircular radial waveguide path 5 via the dielectric substance 25 to the upper/lower directions may be radiated along the front direction by the metal strip lines 26 and 27. As a result, radiation beams to the front direction can be increased and gains can be improved.

It should also be noted that as indicated in the above-described tenth embodiment (FIG. 22) to the twelfth embodiment (FIG. 24), when plural sets of the grooves 8 and 9 are provided, since the period W(interval) of each of the grooves 8 and 9 is changed, the radiation beams can be tilted along either the upper direction, or the lower direction.

Also, in such a case that a plurality of metal strip lines 26 and 27 are provided as indicated in the thirteenth embodiment (FIGS. 25 and 26), since the periods (intervals) of the metal strip lines 26 and 27 are changed, the radiation beams can be tilted a long either the upper direction or the lower direction.

Figure 27:
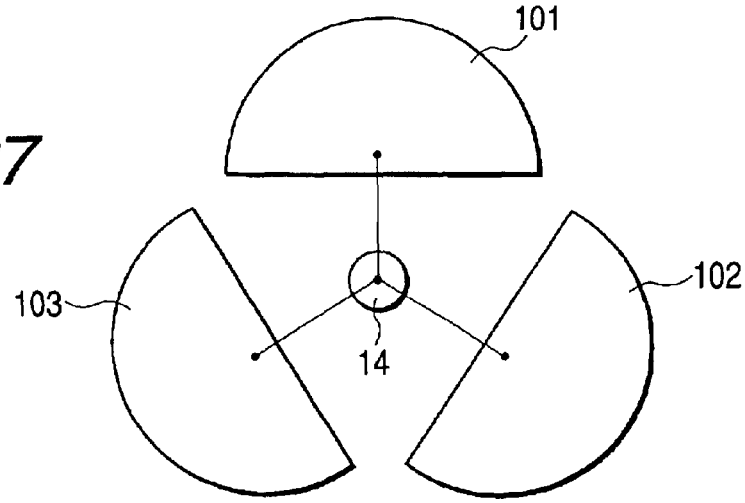
FIG. 27 is a plan view of a multidirectional antenna according to a fourteenth embodiment of the present invention.

FIG. 27 shows a fourteenth embodiment of the invention in which a multidirectional antenna is constituted by semicircular radial antennas. As shown in this figure, three semicircular radial antennas 101 to 103 are circularly arranged at an equal angle of 120° in this case. A signal obtained from each feeder is inphase-combined by a combiner 14. In this case, the semicircular radial antennas 101 to 103 are arranged such that each arcuate portion for radiating a radio wave is located outside.

As each of the above semicircular radial antennas 101 to 103, the semicircular radial antennas according to the above-described embodiments may be suitably selected.

Figure 28A:
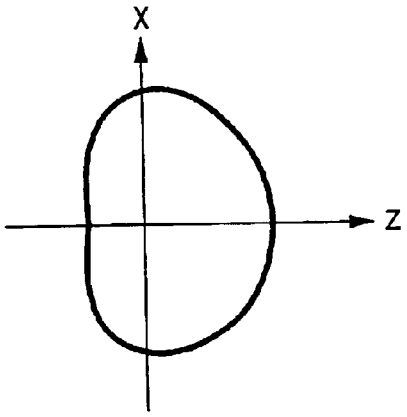
FIGS. 28A to 28C are views showing directivity of each semicircular radial antenna in the multidirectional antenna shown in FIG. 27.
Figure 28B:
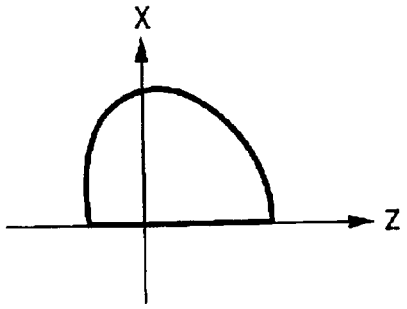
Figure 28C:
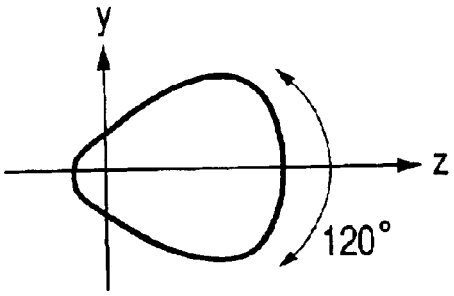

The semicircular radial antennas 101 to 103 constructed as mentioned above have vertical plane directivity and horizontal plane directivity as shown in FIGS. 28A to 28C. In these directivities, as shown in FIG. 27, the vertical direction at a feeder (origin) is set to the x-axis, and the direction passing this origin and parallel to a short-circuit wall is set to the y-axis, and the front face direction perpendicular to the above x and y axes is set to the z-axis.

FIG. 28A shows the vertical plane directivity of the semicircular radial antennas 101 to 103. This directivity is strong in the x-axis direction (vertical direction) and the z-axis direction (front face direction). When the lower waveguide plate of the above semicircular radial antennas 101 to 103 is set to be infinite, the directivity of the upper side half in FIG. 28A is provided as shown in FIG. 28B. FIG.

28C shows the horizontal plane directivity, and this directivity is strong in the z-axis direction (front face direction), and has a beam width of about 120°.

Figure 29A:
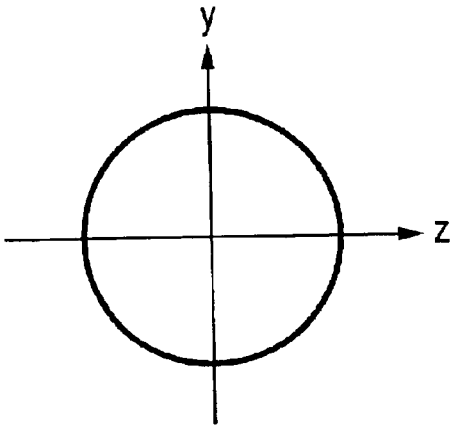
FIGS. 29A and 29B are views showing the directivity of the multidirectional antenna shown in FIG. 27.
Figure 29B:
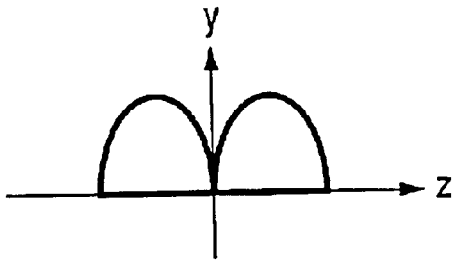

The three semicircular radial antennas 101 to 103 having the above directivities are circularly arranged at an angle of 120° as shown in FIG. 27. When a signal obtained from each feeder is inphase-combined, the horizontal plane directivity becomes nondirectivity as shown in FIG. 29A. Further, in the vertical plane directivity, a null point is caused in a central portion in the x-direction as shown in FIG. 29B. Namely, when the three semicircular radial antennas 101 to 103 are circularly arranged at the angle of 120°, the respective directions approximately become reverse directions. Accordingly, the direction of an electric current flowing through each antenna approximately becomes a reverse direction when the inphase combination is performed. As a result, these directions are mutually cancelled in the vertical plane and the null point is caused in the central portion in the x-direction.

According to the above configuration, not only the horizontal plane can be set to nondirectivity, but also a predetermined gain can be obtained in the vertical plane except for the x-direction (just above).

Figure 30:
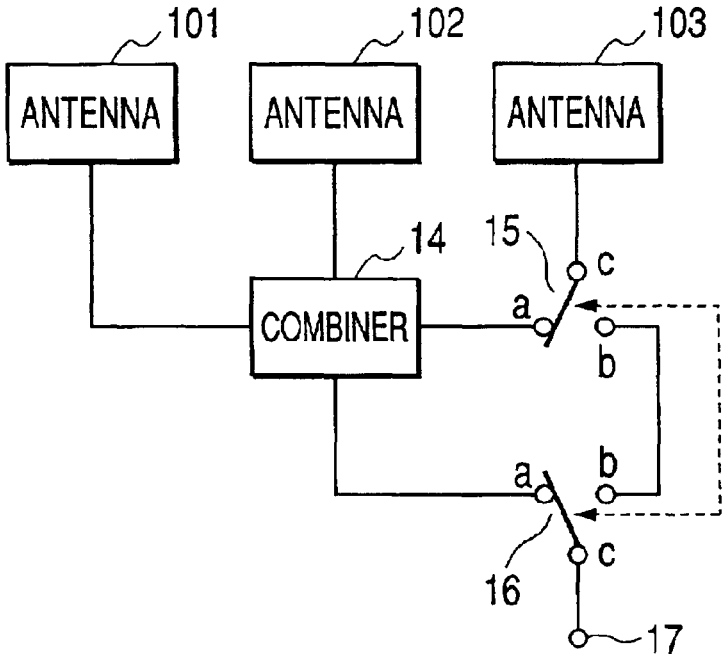
FIG. 30 is a block diagram showing a multidirectional antenna according to a fifteenth embodiment of the present invention.

A fifteenth embodiment of the present invention will next be explained with reference to FIG. 30.

In this embodiment, two semicircular radial antennas 101, 102 shown in the fourteenth embodiment are directly connected to a combiner 14, and another semicircular radial antenna 103 and the combiner 14 are switched and connected by a first switch 15. Further, the output of the combiner 14 and the semicircular radial antenna 103 are switched by the first switch 15 and a second switch 16.

The above first and second switches 15, 16 are operated in association with each other. When a movable contact "c" is switched to a contact "a" on the combiner 14 side, similar to the case of the fourteenth embodiment, the outputs of the semicircular radial antennas 101 to 103 are inphase-combined by the combiner 14, and are taken out of an output terminal 17 through the second switch 16.

When the movable contact "c" of each of the first and second switches 15, 16 is switched to the side of a contact "b", the output of the semicircular radial antenna 103 is taken out of the output terminal 17 through the first and second switches 15, 16. Accordingly, in this case, the semicircular radial antenna 103 becomes an antenna having the directivity of a 120° beam in the horizontal plane and the directivity of the upper direction in the vertical plane.

In this embodiment, the directivity of the antenna can be switched by the first and second switches 15, 16. Accordingly, plural radio waves having different arriving directions can be received by one antenna, and the antenna can be easily arranged even when an arranging position and an arranging area are limited in e.g., an automobile.

Figure 31:
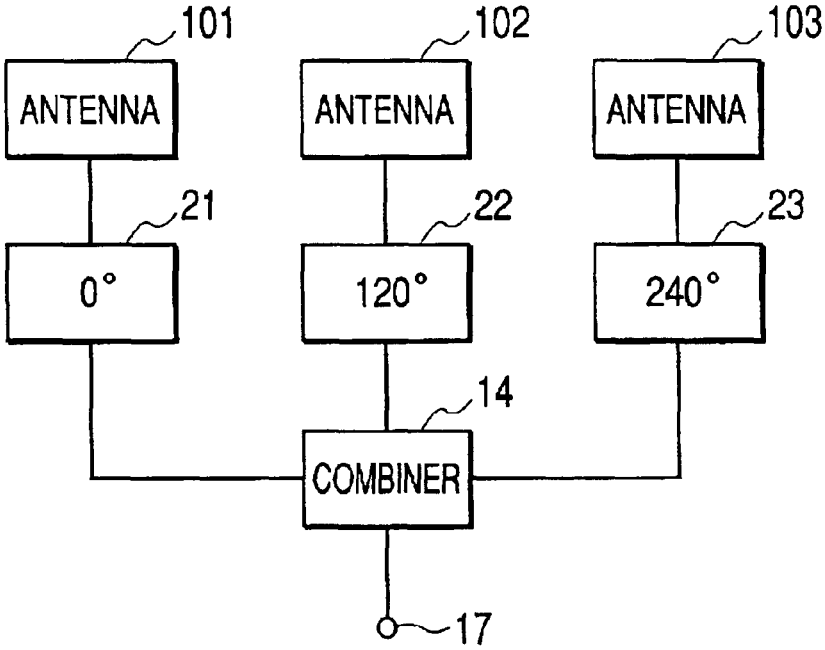
FIG. 31 is a block diagram showing a multidirectional antenna according to a sixteenth embodiment of the present invention.

A sixteenth embodiment of the present invention will next be explained with reference to FIG. 31.

As shown in this figure, this embodiment is constructed such that output signals of the three semicircular radial antennas 101 to 103 shown in the fourteenth embodiment are respectively inputted to a combiner 14 through a 0° phase shifter 21, a 120° phase shifter 22 and a 240° phase shifter 23. Namely, this multidirectional antenna is constructed such that these output signals are combined with a phase difference.

A circularly polarized wave antenna having directivity in the upper direction can be realized by differently combining the phases of the signals obtained by the respective semicircular radial antennas 101 to 103 as mentioned above every 120°. In this case, polarized wave characteristics can be adjusted by changing the combining ratio of the respective semicircular radial antennas 101 to 103.

A seventeenth embodiment of the present invention will next be explained with reference to FIG. 32.

In this embodiment, the signals obtained by the semicircular radial antennas 101 to 103 are respectively inputted to the combiner 14 through the 0° phase shifter 21 and 180° phase shifters 24, 25.

Figure 32:
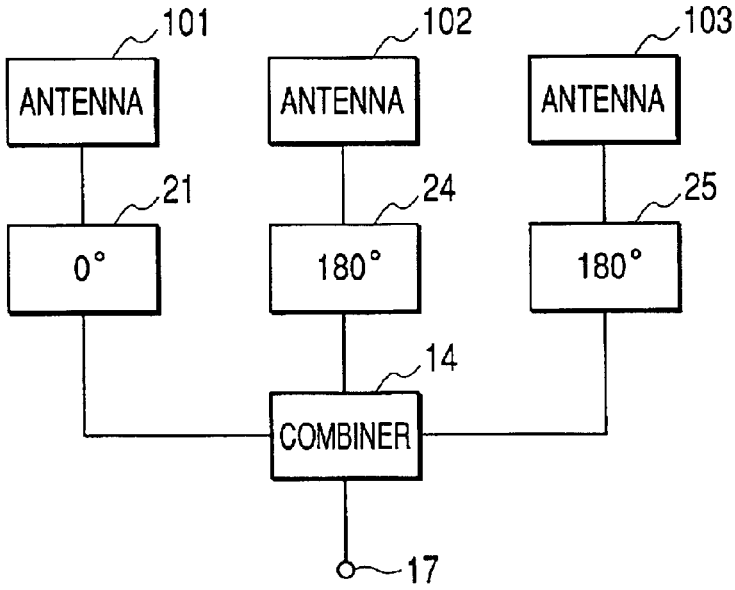
FIG. 32 is a block diagram showing a multidirectional antenna according to a seventeenth embodiment of the present invention.

A linearly polarized wave antenna having directivity in the upper direction can be realized by the construction shown in FIG. 32.

An eighteenth embodiment of the present invention will next be explained with reference to FIG. 33.

In this embodiment, the output signals of the semicircular radial antennas 101 to 103 are respectively distributed into two signals by distributors 31 to 33, and one distributing signal is inputted to a first combiner 14*a* and is inphase-combined. The other distributing signal outputted from each of the distributors 31 to 33 is inputted to a second combiner 14*b* through a 0° phase shifter 21, a 120° phase shifter 22 and a 240° phase shifter 23. Output signals of the above first combiner 14*a* and the second combiner 14*b* are selected by a switch 34 and are outputted from an output terminal 17.

In the above configuration, since the first combiner 14*a* inphase-combines the output signals of the semicircular radial antennas 101 to 103 distributed by the distributors 31 to 33, nondirectivity can be set in the horizontal plane as shown in the fourteenth embodiment of FIG. 27.

Further, the second combiner 14*b* combines the phases of the output signals of the semicircular radial antennas 101 to 103 distributed by the distributors 31 to 33 after these phases are shifted from each other every 120° by the 0° phase shifter 21, the 120° phase shifter 22 and the 240° phase shifter 23. Hence, similar to the sixteenth embodiment shown in FIG. 31, a circularly polarized wave having directivity in the upper direction is obtained. Accordingly, the directivity in the horizontal direction and the directivity in the upper direction can be arbitrarily selected by switching the output signals of the first combiner 14*a* and the second combiner 14*b* by the switch 34.

Figure 33:
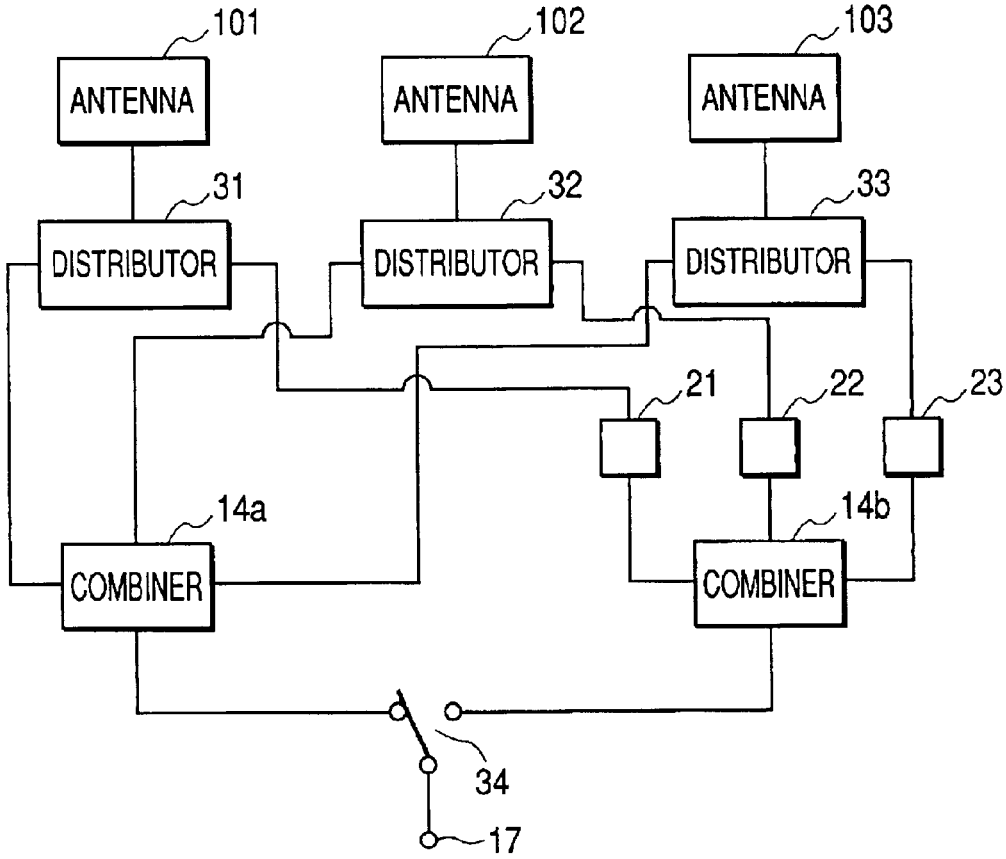
FIG. 33 is a block diagram showing a multidirectional antenna according to an eighteenth embodiment of the present invention.

In FIG. 33, a linearly polarized wave having directivity in the upper direction can be obtained from the second combiner 14*b* by using the 0° phase shifter 21 and the 180° phase shifters 24, 25 as shown in FIG. 32 instead of the 0° phase shifter 21, the 120° phase shifter 22 and the 240° phase shifter 23.

A nineteenth embodiment of the present invention will next be explained with reference to FIG. 34.

This embodiment shows an example of the multidirectional antenna in which a frequency requiring directivity in the horizontal direction and a frequency requiring directivity in the upper direction are different from each other in the above multidirectional antenna shown in FIG. 33.

Figure 34:
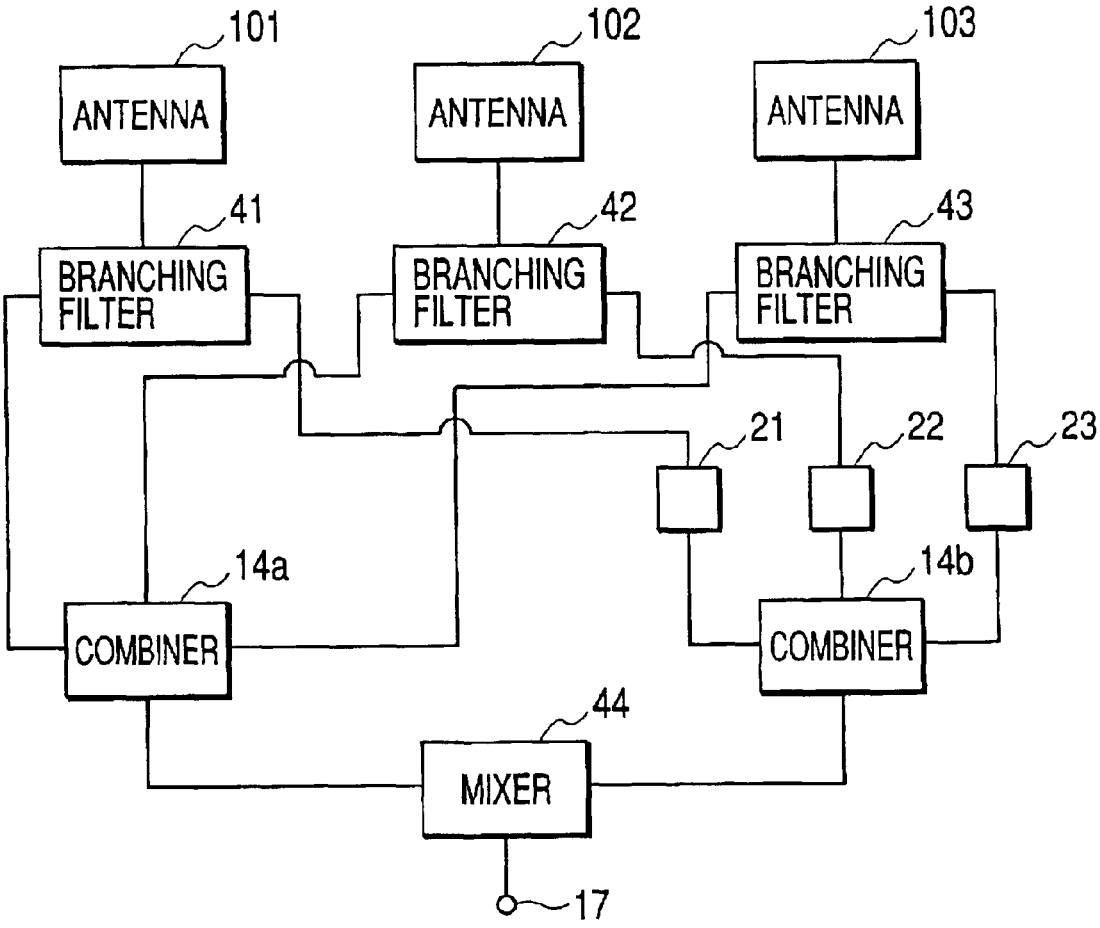
FIG. 34 is a block diagram showing a multidirectional antenna according to a nineteenth embodiment of the present invention.

As shown in FIG. 34, the multidirectional antenna shown in this embodiment respectively inputs output signals of the semicircular radial antennas 101 to 103 to branching filters 41 to 43, and divides these output signals into a signal of the frequency requiring directivity in the horizontal direction and a signal of the frequency requiring directivity in the upper direction. The multidirectional antenna then inputs the signal of the frequency requiring directivity in the horizontal direction to the first combiner 14*a* and performs inphase combination. Further, the multidirectional antenna inputs the signal requiring directivity in the upper direction and divided by the branching filters 41 to 43 to the second combiner 14*b* through the 0° phase shifter 21 and the 120° phase shifter 22 and the 240° phase shifter 23, and then performs phase difference combination. Output signals of the above first combiner 14*a* and the second combiner 14*b* are then mixed with each other by a mixer 44 and are outputted from the output terminal 17.

Nondirectivity can be set in the horizontal plane as shown in the fourteenth embodiment by dividing the signals received by the semicircular radial antennas 101 to 103 by the branching filters 41 to 43 and inphase-combining one of these signals by the first combiner 14*a* as mentioned above.

Further, the phase of the other signal divided by the branching filters 41 to 43 is set to be different every 120° by the 0° phase shifter 21 and the 120° phase shifter 22 and the 240° phase shifter 23, and is then combined by the second combiner 14*b*. Thus, similar to the sixteenth embodiment shown in FIG. 31, it is possible to receive a circularly polarized wave signal having directivity in the upper direction.

Since the signal inphase-combined by the above first combiner 14*a* and the signal combined by the second combiner 14*b* with a phase difference are different in phase from each other, these signals can be mixed by the mixer 44 as they are and can be outputted from the output terminal 17. Accordingly, in this case, it is unnecessary to perform the switching operation of a switch even when the output terminal 17 and a device are connected to each other by one cable.

Each of the above embodiments shows the case in which the multidirectional antenna is constructed by using the three semicircular radial antennas 101 to 103. However, the multidirectional antenna may be also constructed by using two, four or more semicircular radial antennas. However, when the multidirectional antenna is constructed by using two semicircular radial antennas, no directivity in the horizontal plane cannot be obtained, instead, it is obtained a radiation characteristic wherein the gain in the front face direction is large and the gain in the transversal direction is reduced. Further, in this case, a linearly polarized wave in the upper direction is formed in the vertical plane.

Figure 35A:
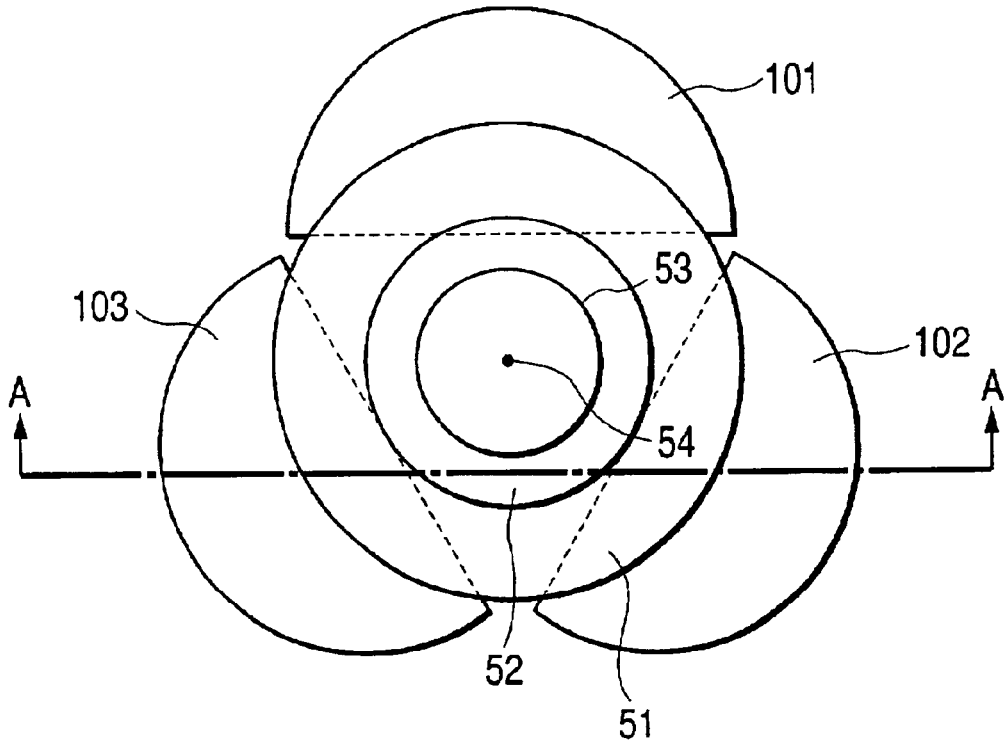
FIG. 35A is a plan view of a multidirectional antenna according to a twentieth embodiment of the present invention.
Figure 35B:
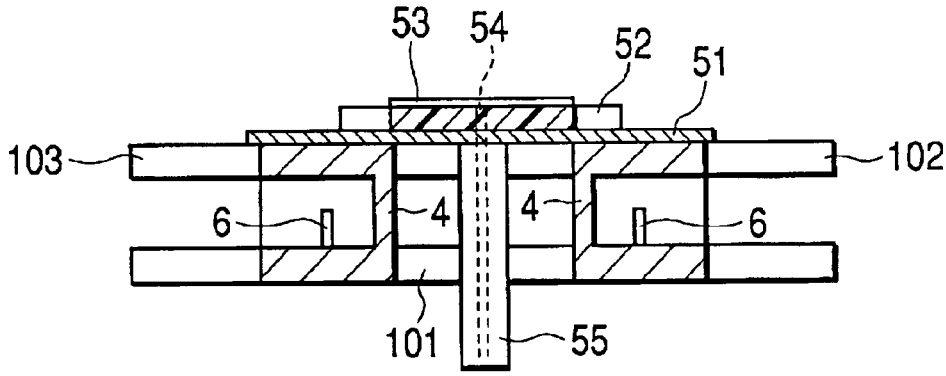
FIG. 35B is a sectional view taken along arrow line A—A of FIG. 35A.

A twentieth embodiment of the present invention will next be explained with reference to FIGS. 35A and 35B.

In this embodiment, a patch antenna is further combined with the multidirectional antenna according to the fourteenth embodiment shown in FIG. 27. Namely, a conductor plate 51 for ground connection is arranged on the upper faces of the semicircular radial antennas 101 to 103, and a patch antenna 53 is arranged on this conductor plate 51 through a dielectric substrate 52.

A coaxial cable 55 for power feeding is connected to a power feeder 54 of the patch antenna 53 from below side. Signals obtained from respective power feeders 6 of the semicircular radial antennas 101 to 103 are inphase-combined by an unillustrated combiner.

The above multidirectional antenna receives the signal of a frequency f1 by the semicircular radial antennas 101 to 103, and also receives the signal of a frequency f2 by the patch antenna 53. In this case, the frequencies f1 and f2 are set to the relation of f2>f1.

In this embodiment, power is easily supplied to the patch antenna 53 since the coaxial cable 55 can be arranged by utilizing a central portion surrounded by the short-circuit walls 4 of the semicircular radial antennas 101 to 103. An optimum operation can be performed in each antenna even when the frequency f2 of the patch antenna 53 is separated twice or more from the frequency f1 of the semicircular radial antennas 101 to 103, i.e., even when f2>2f1 is set.

In the this embodiment, plural patch antennas 53 may be arranged. Further, it is also possible to use an antenna except for the patch antenna, e.g., a monopole antenna, a dipole antenna, a whip antenna, etc.

Figure 36A:
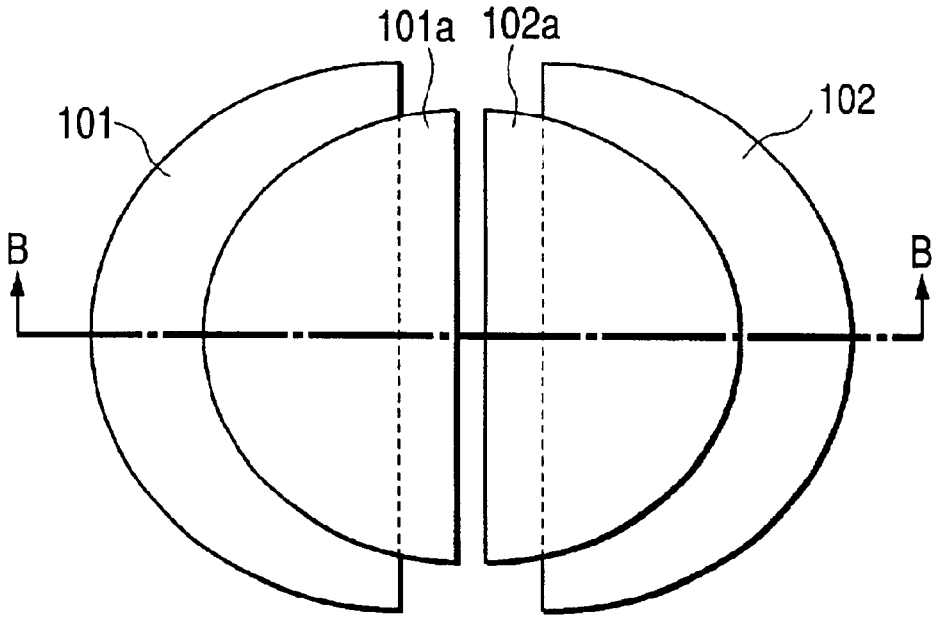
FIG. 36A is a plan view of a multidirectional antenna according to a twenty-first embodiment of the present invention.
Figure 36B:
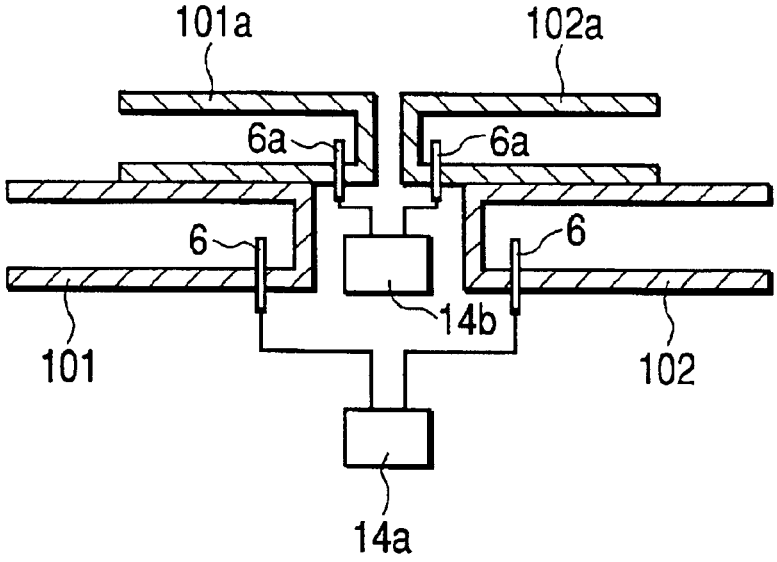
FIG. 36B is a sectional view taken along arrow line B—B of FIG. 36A.

A twenty-first embodiment of the present invention will next be explained with reference to FIGS. 36A and 36B.

In this embodiment, the rear sides of plural semicircular radial antennas such as two semicircular radial antennas 101, 102, i.e., their short-circuit wall 4 sides are oppositely arranged with a predetermined distance. Other semicircular radial antennas 101*a*, 102*a* are arranged on these semicircular radial antennas 101, 102. Namely, the plural semicircular radial antennas are arranged in a multilayered structure.

The above semicircular radial antennas 101, 102 of a lower layer are arranged to receive the signal of a frequency f1, and take-out a signal obtained from each feeder 6 by inphase combination using the first combiner 14*a*. The semicircular radial antennas 101*a*, 102*a* of an upper layer are arranged to receive the signal of a frequency f2, and take-out a signal obtained from each feeder 6*a* by the inphase combination using the second combiner 14*b*.

A different frequency can be allocated every antenna of each layer by forming the multilayered structure as mentioned above.

In this embodiment, each layer is constructed by two semicircular radial antennas, but may be also constructed by using three or more semicircular radial antennas. Further, the number of antennas of each layer may be also set to be different. Further, a conductor plate for ground connection may be also interposed between the antennas of each layer.

Each of the above embodiments shows the case using the metallic plate as a material constituting the semicircular radial antenna, but the semicircular radial antenna can be also constructed by using a film substrate. In this case, a flexible dielectric such as a foaming sheet, etc. is interposed in a semicircular radial waveguide portion. Thus, the antenna can be easily attached by constructing the semicircular radial antenna by using a flexible film substrate, etc. in this way even when an antenna attaching face is e.g., a curved surface such as the ceiling face of an automobile.

Further, the above embodiments show the case constituting the multidirectional antenna using the semicircular radial antenna. However, it is possible to use another antenna, e.g., a patch antenna, a reverse F-type antenna, a mesh antenna having a $\lambda/2$ dimension.

Figure 37:
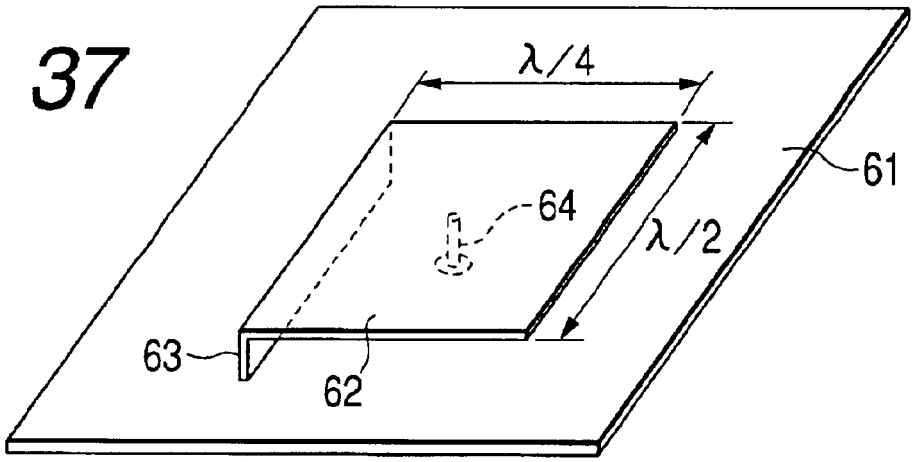
FIG. 37 is a perspective view showing a constructional example of a patch antenna.

FIG. 37 shows a constructional example of a patch antenna per se. A patch antenna element 62 is arranged with a predetermined distance above a conductor plate 61 for ground connection. For example, this patch antenna element 62 is formed in a rectangular shape having $\lambda/4$ in width and $\lambda/2$ in length. One side portion of the patch antenna element 62 is short-circuited to the conductor plate 61 by a short-circuit wall 63. The short-circuit wall 63 short-circuits the patch antenna element 62 to the conductor plate 61, and holds the patch antenna element 62 in a predetermined position. An power supply pin 64 is arranged in the conductor plate 61, and supplies power to a central portion of the patch antenna element 62. A dielectric may be also interposed between the above conductor plate 61 and the patch antenna element 62.

Figure 38:
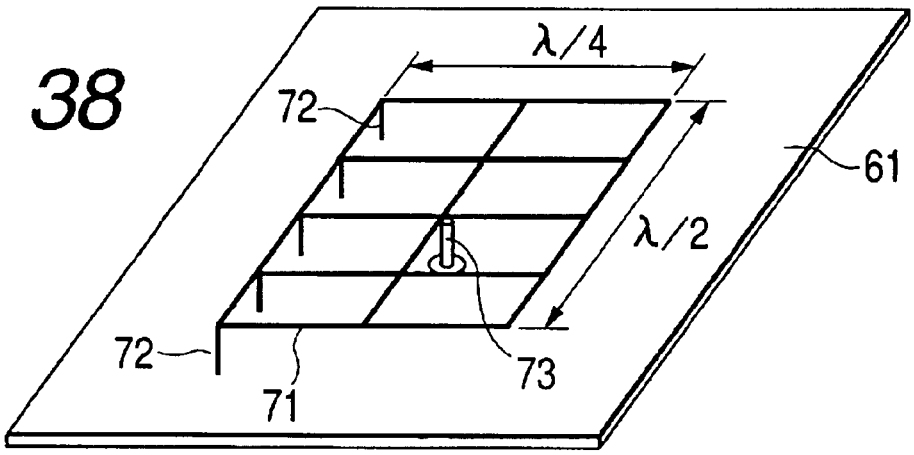
FIG. 38 is a perspective view showing a constructional example of a mesh antenna.

FIG. 38 shows a constructional example of the mesh antenna per se having a $\lambda/2$ dimension. In this mesh antenna, a mesh antenna element 71 is arranged instead of the patch antenna element 62 in the patch antenna shown in FIG. 37. For example, the mesh antenna element 71 is formed in a rectangular shape having $\lambda/4$ in width and $\lambda/2$ in length, and is divided into two meshes (an interval of $\lambda/2$) in the width direction and four meshes (an interval of $\lambda/8$) in the longitudinal direction. Further, the mesh antenna element 71 short-circuits an intersection point portion of each mesh in one side portion to a conductor plate 61 for ground connection by a short-circuit pin 72. Further, a feeder 73 is arranged in the conductor plate 61, and supplies power to a central portion of the mesh antenna element 71.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A semicircular radial antenna, comprising:

a pair of semicircular waveguide plates, each having a pair of linear edge portions, an arcuate edge portion defined between the linear edge portions, the waveguide plates spaced from each other in a vertical direction;

a connecting member, having a conductive face which physically and electrically connects at least a part of the linear edge portions in each waveguide plate; and a single feeder, provided between the waveguide plates so as to face the conductive face, the single feeder being spaced from the conductive face by a distance which is no greater than one fourth of a wavelength of a beam to be radiated, wherein at least one of the following requirements is satisfied:

i) a position of a curvature center of the arcuate portion in one of the waveguide plates is different from that in the other one of the waveguide plates;

ii) a curvature radius of the arcuate portion in one of the waveguide plates is different from that in the other one of the waveguide plates; and iii) a slanted angle of a peripheral face of the arcuate portion, which connects a top face and a bottom face of each waveguide plate, in one of the waveguide plates is different from that in the other one of the waveguide plates.

2. The semicircular radial antenna as set forth in claim 1, wherein at least one of the waveguide plates is detachably fixed on the connecting member.

3. The semicircular radial antenna as set forth in claim 1, further comprising a combiner through which the semicircular radial antenna is connected with at least one semicircular radial antenna having the same configuration, wherein the combiner combines signals obtained from each feeder.

4. The semicircular radial antenna as set forth in claim 3, further comprising a switch for selecting a signal outputted from the combiner or a signal obtained from the feeder of one semicircular radial antenna.

5. The semicircular radial antenna as set forth in claim 3, further comprising a phase shifter which shifts a phase of a signal obtained from the feeder so as to receive a circularly polarized wave signal together with another semicircular radial antenna.

6. The semicircular radial antenna as set forth in claim 3, further comprising a phase shifter which shifts a phase of a signal obtained from the feeder so as to receive a linearly polarized wave signal together with another semicircular radial antenna.

7. The semicircular radial antenna as set forth in claim 3, further comprising:

a first combiner, through which the semicircular radial antenna is connected with at least one semicircular radial antenna having the same configuration;

a phase shifter which shifts a phase of a signal obtained from the feeder so as to receive a circularly polarized wave signal together with another semicircular radial antenna; and a second combiner, through which the semicircular radial antenna is connected with another semicircular radial antenna via the phase shifter.

8. The semicircular radial antenna as set forth in claim 7, further comprising a branching filter which transmits a signal having a first frequency to the first combiner and a signal having a second frequency to the second combiner.

9. The semicircular radial antenna as set forth in claim 3, further comprising: a first combiner, through which the semicircular radial antenna is connected with at least one semicircular radial antenna having the same configuration;

a phase shifter which shifts a phase of signal obtained from the feeder so as to receive a linearly polarized wave signal together with another semicircular radial atenna; and a second combiner, through which the semicircular radial antenna is connected with another semicircular radial antenna via the phase shifter.

10. The semicircular radial antenna as set forth in claim 9, further comprising a branching filter which transmits a signal having a first frequency to the first combiner and a signal having a second frequency to the second combiner.

11. The semicircular radial antenna as set forth in claim 3, wherein the semicircular radial antenna is connected with at least two semicircular radial antennas such that the semicircular radial antennas are circularly arranged at an equal interval.

12. The semicircular radial antenna as set forth in claim 3, further comprising at least one second antenna for receiving a wave signal having a frequency higher than a frequency of a wave signal received by the semicircular radial antenna.

13. The semicircular radial antenna as set forth in claim 3, further comprising at least two second semicircular antenna for receiving a wave signal having a frequency different from a frequency of a wave signal received by the semicircular antenna.

14. The semicircular radial antenna as set forth in claim 1, wherein the waveguide plates are provided as film substrates, and a flexible dielectric substance is placed between the waveguide plates.

15. A semicircular radial antenna, comprising:

a pair of semicircular waveguide plates, each having a pair of linear edge portions, an arcuate edge portion defined between the linear edge portions, the waveguide plates spaced from each other in a vertical direction;

a connetion member, having a conductive face which physically and electrically connects at least a part of the liner edge portions in each waveguide plate; and a single feeder, provided between the waveguide plates so as to face the conductive face, the feeder being spaced from the connecting member by a distance which is no greater than one fourth of a wavelength of a beam to be radiated, wherein at least one of the following requirements is satisfied:

i) a position of a curvature center of the arcuate portion in at least one of the waveguide plates is selected between the connecting member and the feeder, in accordance with a desired horizontal beam radiation characteristic;

ii) a curvature radius of the arcuate portion in at least one of the waveguide plates is selected in accordance with a desired vertical beam radiation characteristic; and iii) a slanted angle of a peripheral face of the arcuate portion, which connects a top face and a bottom face of each waveguide plate, in at least one of the waveguide plates is selected in accordance with a desired vertical beam radiation characteristic;

wherein at least one of the waveguide plates is slidable independently from the other one of the waveguide plates.

16. A semicircular radial antenna, comprising:

a pair of semicircular waveguide plates, each having a pair of linear edge portions, a arcuate edge portion defined between the linear edge portions, the waveguide plates spaced from each other in a vertical direction;

a connecting member, having a conductive face which physically and electrically connects at least a part of the linear edge portions in each waveguide plate;

a single feeder, provided between the waveguide plates so as to face the conductive face, the feeder being spaced from the connecting member by a distance which is no greater than one fourth of a wavelength of a beam to be radiated;

a first plate member disposed on a top face of an upper waveguide plate so as to form a first groove between the top face and the plate member and along the arcuate portion; and a second plate member disposed on a bottom face of a lower waveguide plate so as to form a second groove extending along the arcuate portion between the bottom face and the plate member, wherein at least one of the following requirements is satisfied:

i) a position of a curvature center of the arcuate portion in at least one, of the waveguide plates is selected between the connecting member and the feeder, in accordance with a desired horizontal beam radiation characteristic;

ii) a curvature radius of the arcuate portion in at least one of the waveguide plates is selected in accordance with a desired vertical beam radiation characteristic; and iii) a slanted angle of a peripheral face of the arcuate portion, which connects a top face and a bottom face of each waveguide plate, in at least one of the waveguide plates is selected in accordance with a desired vertical beam radiation characteristic.

17. The semicircular radial antenna as set forth in claim 4, wherein each of the first groove and the second groove has a depth of $0.2\lambda$, where $\lambda$is a wavelength of a radio wave used in the antenna.

18. A semicircular radial antenna, comprising;

a pair of semicircular waveguide plates, each having a pair of linear edge portions, an arcuate edge portion defined between the linear edge portions, the waveguide plates spaced from each other in a vertical direction;

a connecting member, having a conductive face which physically and electrically connects at least a part of the linear edge portions in each waveguide plate; and a single feeder, provided between the waveguide plates so as to face the conductive face, the feeder spaced from the connecting member by a distance which is no greater than one fourth of a wavelength of a beam to be radiated, wherein the peripheral face of the arcuate portion is formed with a plurality of grooves extended along the arcuate portion; and wherein an interval between the grooves is equal to a wavelength of a radio wave used in the antenna.

19. The semicircular radial antenna as set forth in claim 5, further comprising:

extended portions protruded from a top face of an upper waveguide plate and a bottom face of a lower waveguide plate in the vertical direction, and extending along the arcuate portion of each waveguide plate, extended portion being formed with at least one groove extending along the arcuate portion.

20. The semicircular radial antenna as set forth in claim 6, further comprising a dielectric member formed along the peripheral face of the arcuate portion and a peripheral face of each extended portion.

21. A semicircular radial antenna, comprising:

a pair of semicircular waveguide plates, each having a pair of linear edge portions, an arcuate edge portion defined between the linear edge portions, the waveguide plates spaced from each other in a vertical direction;

a connecting member, having a conductive face which physically and electrically connects at least a part of the liner edge portions in each waveguide plate; and a single feeder, provided between the waveguide plates so as to face the conductive face, the feeder being spaced from the connecting member by a distance which is no greater than one fourth of a wavelength of a beam to be radiated;

wherein the peripheral face of the arcuate portion is formed with a plurality of grooves extending along the arcuate portion; and wherein an interval between the grooves is determined in accordance with a tilt angle of a beam radiation in the vertical direction.

22. A semicircular radial antenna, comprising:

a pair of semicircular waveguide plates, each having a pair of linear edge portions, an arcuate edge portion defined between the linear edge portions, the waveguide plates spaced from each other in a vertical direction;

a connecting member, having a conductive face which physically and electrically, connects at least a part of the linear edge portions in each waveguide plate;

a single feeder, provided between the waveguide plates so as to face the conductive face, the feeder being spaced from the connecting member by a distance which is no greater than one fourth of a wavelength of a beam to be radiated; and a dielectric member formed along the peripheral face of the arcuate portion, wherein a peripheral face of the dielectric member is formed with a plurality of grooves extending along the arcuate portion at positions where are substantially opposing to the peripheral faces of the arcuate portions in the respective waveguide plates; and wherein an interval between the grooves is determined in accordance with a tilt angle of a beam radiation in the vertical direction.

23. A semicircular radial antenna comprising:

a pair of semicircular waveguide plates, each having a pair of linear edge portions, an arcuate edge portion defined between the linear edge portions, the waveguide plates spaced from each other in a vertical direction:

a connecting member, having a conductive face-which physically and electrically connects at least a part of the linear edge portions in each waveguide plate;

a single feeder, provided between the waveguide plates so as to face the conductive face, the feeder being spaced from the connecting member by a distance which is no greate than one fourth of a wavelength of a beam to be radiated; and a dielectric member formed along the peripheral face of the arcuate portion, wherein a peripheral face of the dielectric member is formed with a plurality of metal strip lines extending along the arcuate portion at positions where are substantially opposing to the peripheral faces of the arcuate portions in the respective waveguide plates.

24. The semicircular radial antenna as set forth in claim 11, wherein an interval between the metal strip line is determined in accordance with a tilt angle of a beam radiation in the vertical direction.

25. A semicircular radial antenna, comprising:

a pair of semicircular wave guide plates, each having a pair of linear edge portions, an arcuate edge portion defined between the linear edge portions, the waveguide plates spaced from each other in a vertical direction;

a connecting member, having a conductive face which physically and electrically connects at least a part of the linear edge portions in each, waveguide plate;

a single feeder, provided between the waveguide plates so as to face the conductive face, the feeder being spaced from the connecting member by a distance which is no greater than one fourth of a wavelength of a beam to be radiated; and a dielectric member formed along the peripheral face of the arcuate portion position, wherein a peripheral face of the dielectric member is formed with a plurality of grooves extending along the arcuate portion at positions where are substantially opposing to the peripheral faces of the arcuate, portions in the respective waveguide plates; and wherein an interval between the grooves is equal to a wavelength of a radio wave used in the antenna.

* * * * *